US007817949B2

(12) United States Patent
Shirose et al.

(10) Patent No.: US 7,817,949 B2
(45) Date of Patent: Oct. 19, 2010

(54) INTERMEDIATE TRANSFER BELT FOR IMAGE-FORMING APPARATUSES

(75) Inventors: Meizo Shirose, Hachioji (JP); Satoshi Uchino, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 312 days.

(21) Appl. No.: 11/916,581

(22) PCT Filed: Jun. 29, 2005

(86) PCT No.: PCT/JP2005/011962

§ 371 (c)(1),
(2), (4) Date: Dec. 5, 2007

(87) PCT Pub. No.: WO2007/000821

PCT Pub. Date: Jan. 4, 2007

(65) Prior Publication Data

US 2009/0116881 A1 May 7, 2009

(51) Int. Cl.
*G03G 15/01* (2006.01)

(52) U.S. Cl. ..... 399/302; 399/308

(58) Field of Classification Search ..... 399/302, 399/308; 428/327

See application file for complete search history.

(56) References Cited

U.S. PATENT DOCUMENTS 6,489,020 B1 * 12/2002 Caruthers et al. ..... 428/327

FOREIGN PATENT DOCUMENTS

JP 10-120935 (A) 5/1998
JP 2002-156835 (A) 5/2002
JP 2004-045916 (A) 2/2004
JP 2004-287005 (A) 10/2004
JP 2005-37586 2/2005
JP 2005-181753 7/2005

OTHER PUBLICATIONS

Form PCT/ISA/210 (International Search Report) dated Sep. 6, 2005.

The International Preliminary Report on Patentability and Accompanying Written Opinion mailed in related International Patent Application No. PCT/JP2005/011962 on Jan. 17, 2008. (with English Translation).

Japanese Office Action issued in corresponding Japanese Patent Application No. 2007-523269, dated Jul. 21, 2009, and English language translation.

The Second Office Action issued in corresponding Chinese Application No. 200580050935X dated Nov. 6, 2009 and an English Translation thereof.

* cited by examiner

*Primary Examiner*—Hoang Ngo
(74) *Attorney, Agent, or Firm*—Buchanan Ingersoll & Rooney PC

(57) ABSTRACT

The present invention provides an intermediate transfer belt allowing formation of a high-quality toner image.

The present invention relates to an intermediate transfer belt having at least one resin layer that is wound around at least a pair of supporting shafts, for receiving a toner image transferred from a photosensitive member, the resin layer comprising a carbon black dispersed in a base resin material, the carbon black having a number-average particle size of Feret's diameter of 5 to 300 nm and containing primary particles in an amount of 5% or more on a number basis.

6 Claims, 7 Drawing Sheets

INTERMEDIATE TRANSFER BELT FOR IMAGE-FORMING APPARATUSES

TECHNICAL FIELD

The present invention relates to an intermediate transfer belt for use in image-forming apparatuses in electrophotographic process such as electrophotographic copying machine or printer.

BACKGROUND ART

Generally, copying machines and printers employing an image-forming apparatus and forming an image in the electrophotographic process have been available commercially. An image is formed in such an image-forming apparatus in the following manner. Specifically, an image is formed by generating an electrostatic latent image on a photosensitive drum charged by photoirradiation, forming a toner image by adhesion of a toner on the electrostatic latent image, and transferring the toner image onto a recording paper. There are two methods of transferring the toner image; a method of transferring it directly from photosensitive member onto recording paper and a method of transferring once on intermediate transfer belt and then retransferring the image onto recording paper.

In a color copying machine or printer in the electrophotographic process, toner images in cyan, magenta, yellow, and black are formed respectively, giving a color image in combination thereof. Recently, widely used is a process of forming a color toner image once on an intermediate transfer belt from these toner images and retransferring the image onto recording paper (see, for example, Patent Document 1).

FIG. 6 is a sectional view illustrating the configuration of the image-forming apparatus disclosed in Patent Document 1. The image-forming apparatus is a so-called tandem-type image-forming apparatus, wherein: 10 represents an image-supporting photosensitive member; 11, a Scorotron charger; 12, an image-writing device; 13, a developing device; 14, a cleaning unit for cleaning the surface of the photosensitive member 10; 15, a cleaning blade; 16, a development sleeve; and 20, an intermediate transfer belt.

Each image-forming unit 1 has a photosensitive member 10, a Scorotron charger 11, a developing device 13, a cleaning unit 14, and others; the mechanical configurations of the image-forming units 1 in various colors are the same as each other; and thus in the Figure, reference numerals are allocated only to the image-forming unit in Y (yellow), and those for the elements in the image-forming apparatuses in M (magenta), C (cyan) and K (black) are eliminated.

The image-forming units 1 in various colors are placed in the order of Y, M, C, and K in the running direction of the intermediate transfer belt 20, and each photosensitive member 10 is in contact with the surface of the stretched intermediate transfer belt 20 and revolves at a constant linear velocity in the same direction as the running direction of the intermediate transfer belt 20 at the contact point.

The intermediate transfer belt 20 is stretched by a driven roller 21, a transfer roller 22, a tension roller 23, a charge-eliminating roller 27, a driving roller 24 and others, and the these rollers, the intermediate transfer belt 20, a transfer device 25, a cleaning unit 28, a transfer auxiliary roller 29 and others constitute a belt unit 3. The intermediate transfer belt 20 is driven by rotation of the driving roller 24, which in turn is driven by a drive motor not shown in Figure.

The photosensitive member 10 is a cylindrical metal base material, for example of aluminum, carrying an electrically conductive layer and a-Si layer or a photosensitive layer of an organic photoreceptor (organic photoconductor) formed on the external surface thereof and revolves counterclockwise in the direction indicated by the arrow in the Figure while the electrically conductive layer is grounded.

The electrical signal corresponding to the image data from the image-reading device 80 is converted into an optical signal by image-forming laser, and laser beam is irradiated on the photosensitive member 10 by the image-writing device 12.

The developing device 13 has a cylindrical nonmagnetic development sleeve 16 of stainless steel or aluminum revolving in the same direction as that of the photosensitive member 10, as separated from the peripheral surface of the photosensitive member 10 by a particular distance at the closest position.

The transfer device 25 has a function to transfer the toner image formed on the photosensitive member 10 onto the intermediate transfer belt 20, while a direct current at the polarity opposite to that of the toner is applied to the transfer device 25. A transfer roller may be used as the transfer device 25, instead of the corona discharger.

The numeral 26 represents a ground roller separable via the intermediate transfer belt 20 from the transfer roller 22 that retransfers the toner image formed on the intermediate transfer belt 20 onto an image-receiving medium P.

The cleaning unit 28 is installed at a position facing a driving roller 24 via the intermediate transfer belt 20. After transfer of the toner image onto the image-receiving medium P, the toner remaining on the intermediate transfer belt 20 is weakened electrostatically and separated from the intermediate transfer belt by a charge-eliminating roller 27 to which an AC voltage convoluted with a DC voltage at the polarity the same as or different from that of the toner is applied, and the separated toner is fed by a conveyer roller 282 onto a conveyer screw 283 and then discharged through a conveyer pipe into a discard duct.

The numeral 4 represents a fixing device, wherein: 41 represents a heating roller; 42, a pressure roller; 43, a guide plate; 44, a fixing-device paper discharge roller; and 81, a main-body paper discharge roller. The numeral 70 represents a paper delivery roller; 71, a timing roller; 72, a paper cassette; and 73, a conveyer roller.

In an image-forming apparatus in the configuration above, a color image is formed in the following image-forming process: First, simultaneously with initiation of image recording, the photosensitive member 10 of color signal Y revolves counterclockwise as indicated by the arrow by operation of the photosensitive member-driving motor not shown in Figure, and simultaneously, an electric potential is applied to the photosensitive member 10 by the electrostatic charging action of the Scorotron charger 11.

After application of the electric potential to the photosensitive member 10, an image corresponding to the Y image data is written by the image-writing device 12, leaving an electrostatic latent image corresponding to the Y document image on the surface of the photosensitive member 10.

The electrostatic latent image is reversely developed in the non-contact state by the Y developing device 13, forming a Y toner image on the photosensitive member 10 by rotation of the photosensitive member 10.

The Y toner image formed on the photosensitive member 10 is transferred onto the intermediate transfer belt 20 by action of the Y transfer device 25.

After the Y toner image is transferred on the intermediate transfer belt 20, the photosensitive member 10 is cleaned by the cleaning unit 14, before entering into the next image-forming cycle (subsequent M, C, or K cleaning process is the same as that above, and duplicated description is omitted).

Then, an image corresponding to the M (magenta) color signal, i.e., M image data is written by the image-writing device 12, giving an electrostatic latent image corresponding the M document image formed on the surface of the photosensitive member 10. The electrostatic latent image is converted to a M toner image formed on the photosensitive member 10 by the M developing device 13, which is then superimposed on the Y toner image by the M transfer device 25 synchronously with the Y toner image on the intermediate transfer belt 20.

In a similar manner, a C (cyan) toner image is transferred on the Y and M superimposed toner image synchronously with the Y and M superimposed toner image by the C transfer device 25, and a K (black) toner image is transferred on the Y, M and C superimposed toner image synchronously with the Y, M, and C superimposed toner image by the K transfer device 25, forming a Y, M, C and K superimposed toner image on the intermediate transfer belt 20. The intermediate transfer belt 20 carrying the superimposed toner image is sent clockwise as indicated by the arrow.

On the other hand, the image-receiving medium P is fed from a paper cassette 72 by a paper delivery roller 70, sent via a conveyer roller 73 to a timing roller 71, and fed by operation of the timing roller 71 to the transfer region S of a transfer roller 222, to which a DC voltage in the same polarity as that of the toner is applied (in contact with the ground roller 26), synchronously with the superimposed toner image on the intermediate transfer belt 20, transferring the superimposed toner image formed on the intermediate transfer belt 20 onto the image-receiving medium P. Then, the intermediate transfer belt 20 is processed with the charge-eliminating roller 27 for reduction of the charge on the residual toner and cleaned with a cleaning blade 281 in contact with the intermediate transfer belt 20, before entering into the next image-forming cycle.

The image-receiving medium P carrying the transferred superimposed toner image is sent to the fixing device 40 and held under heat and pressure in the nip region T between the heating roller 41 and the pressure roller 42, and then, the image-receiving medium P carrying the fused superimposed toner image is discharged by the paper discharge roller 81 into a paper discharge tray 82.

The surface of the intermediate transfer belt should be resistant to friction, because the intermediate transfer belt plays a role to carry and convey the superimposed toner image and transfer it favorably onto the image-receiving medium P as described above, and is subjected to the mechanical stress by cleaning blade 281 after transfer.

Patent Document 1 discloses that the intermediate transfer belt 20 is preferably an endless belt having a volume resistivity of 106 to 1012 Ω·cm and having a two-layer structure seamless belt of a base material and an anti-toner-filming layer. The base materials exemplified there include a semiconductive film having a thickness of 0.1 to 1.0 mm and containing an engineering plastic resin, such as modified polyimide, heat-hardening polyimide, ethylene tetrafluoroethylene copolymer, polyvinylidene fluoride or nylon alloy, and a conductive material dispersed therein, and a semiconductive rubber belt having a thickness of 0.5 to 2.0 mm and containing a silicone rubber, polyurethane rubber or the like and a conductive material dispersed therein; and the anti-toner-filming layer exemplified above is a fluorine-based coating film having a thickness of 5 to 50 μm. The conductive material commonly added to such an intermediate transfer belt is carbon black.

[Patent Document 1] Japanese Unexamined Patent Publication No. 2005-37586

DISCLOSURE OF INVENTION

Technical Problems to be Solved

However, intermediate transfer belts containing a commercially available carbon black as its conductor often cause a problem of lack in uniformity in image density of a constant-density image when it is developed. Intensive studies by the inventors revealed that it is because of local unevenness in resistance characteristics on the intermediate transfer roller, which is derived from the carbon black dispersed in the base material.

Normally, the carbon black is composed of secondary particles formed by a plurality of basic particles that are chemically and/or physically combined with one another, that is, an aggregate (referred to also as a structure) (FIG. 7). This aggregate has a complex aggregated structure that is branched into irregular chain forms. Since the aggregates are formed into secondary aggregates by a Van der Waals force or through simple aggregation, adhesion, entangling, or the like, it has been difficult to obtain a sufficiently micro-dispersed structure. Because of a complex form, even when the carbon black is dispersed in a medium of the substrate, it was difficult that those compositions showed uniform resistance.

In particular, poor dispersibility of carbon black in silicone or urethane when it is used as a base belt material because of low affinity between the base material and carbon black is also one reason for the difficulty in obtaining uniform conductivity.

An object of the present invention is to provide an intermediate transfer belt allowing formation of a high-quality toner image.

Means to Solve the Problems

The object is achieved by the following inventions (1) to (7):

(1) An intermediate transfer belt having at least one resin layer that is wound around at least a pair of supporting shafts, for receiving a toner image transferred from a photosensitive member, the resin layer comprising a carbon black dispersed in a base resin material, the carbon black having a number-average particle size of Feret's diameter of 5 to 300 nm and containing primary particles in an amount of 5% or more on a number basis.

(2) The intermediate transfer belt described in (1), wherein the resin layer has multiple resin layers and the carbon black is dispersed in at least one resin layer among the multiple resin layers.

(3) The intermediate transfer belt described in (2), wherein the multiple resin layers include a base layer and a surface layer formed on the base layer.

(4) The intermediate transfer belt described in (3), wherein the carbon black is dispersed in the base layer.

(5) The intermediate transfer belt described in (3), wherein the carbon black is dispersed in the surface layer.

(6) The intermediate transfer belt described in any one of (1) to (5), wherein the carbon black is surface-treated with an organic compound.

(7) The intermediate transfer belt described in (6), wherein the organic compound includes at least one phenol compound and/or one amine compound.

The following description will discuss primary particles in the present application. Normally, carbon black is present in an aggregate form, and the aggregate is a form, in which plurality of basic particles are chemically and/or physically aggregated. In the present application, the primary particles refer to the basic particles. However, the primary particles do not refer to the basic particles in a state in which the basic particles form an aggregate, but refer to particles that are present stably in a state in which the basic particles are separate from the aggregate. Secondary particles in the present application refer to an aggregate formed by aggregating the basic particles. Here, in the present application, secondary aggregates formed by aggregation of the aggregates are generally referred to as secondary particles.

FIG. 1 is a drawing illustrating the relationship between secondary particles and basic particles. The state formed by aggregating the basic particles is defined as a secondary particle. FIG. 2 represents a state in which basic particles that have formed secondary particles are separated from the secondary particles and are stably maintained, and this particle that is present as a single basic particle is defined as a primary particle.

The description will be further given as follows.

(1) Number Average Particle Size of Feret's Diameter

The carbon black of the present invention has a number average particle size of Feret's diameter in the range from 5 to 300 nm. The range is preferably from 10 to 100 nm, particularly preferably from 10 to 80 nm.

By providing this range, the carbon blacks can be dispersed densely on the surface of, for example, a resin molded product, and the surface characteristics can be improved.

Here, an object to be measured in a number average particle size of Feret's diameter is each of the primary particles and the secondary particles of carbon black that are present in a stable state. In the case of carbon black that is present as an aggregate, the aggregate is the object to be measured, and the basic particles in the aggregate are not measured.

The controlling process into this number average particle size can be achieved by the following operations: the particles of the carbon black that are present as an aggregate and have basic particle sizes within the above-mentioned range are properly selected and processed, or conditions during the production process for dividing the aggregate into primary particles are altered.

The number average particle size of Feret's diameter can be observed by means of an electron microscope.

Upon finding the number average particle size of Feret's diameter from carbon black simple substance, an enlarged photograph may be taken at magnification of 100000 by using a scanning electron microscope (SEM), and 100 particles may be properly selected to calculate the number average particle size of Feret's diameter.

In the case when the average particle size of carbon black is found from a molded product such as a resin, an enlarged photograph may be taken at magnification of by using a transmission electron microscope (TEM), and 100 particles may be properly selected to calculate the number average particle size.

The Feret's diameter, used in the present invention, refers to the largest length in a predetermined one direction of each of carbon black particles, among carbon black particles photographed by using the above-mentioned electron microscope. The largest length represents a distance between parallel lines, that is, two parallel lines that are drawn perpendicular to the predetermined one direction so as to be made in contact with the outer diameter of each particle.

For example, in FIG. 3, with respect to a photograph 1300 of carbon black particles 1200 taken by using an electron microscope, one direction 1201 is arbitrarily determined. The distance between two straight lines 1202 that are perpendicular to the predetermined direction 1201 and made in contact with each carbon black particle 1200 represents a Feret's diameter 1203.

The carbon black of the present invention is preferably designed to have a number average particle size of Feret's diameter of the primary particles of 2 to 100 nm, and particularly 3 to 80 nm. By using the carbon black within this range, the strength thereof can be increased when dispersed in a resin molded product. The degree of gloss of the molded product can be improved, and a superior finished state can be achieved. The method for measuring the number average particle size of the primary particles is the same as the measuring method for the number average particle size of the carbon black. Here, the number of measured particles corresponds to 100 primary particles.

(2) Rate of Primary Particles

The carbon black of the present invention contains 5% or more of primary particles in the carbon black on a basis of number. The upper limit is 100%. The rate preferably varies depending on the industrial fields to which it is applied. As the rate of content of the primary particles increases, the better performance is obtained in the product in the industrial field. In the case of resin molded products, mechanical strength, surface gloss property and the like can be improved. More specifically, the better results can be obtained in the order of 10% or more, 20% or more, 30% or more, 40% or more and 50% or more. Upon measuring the rate of the primary particles, the same process as described above is carried out by using the electron microscope, and the number of measured particles is calculated by counting the primary particles that are present in 1000 carbon black particles.

(3) Carbon Black

The carbon black of the present invention is preferably designed so that the surface of each of carbon black particles that are stably present finally is surface-treated (including a graft treatment) with an organic compound or the like.

The rate of graft treatment is determined in the following manner.

Supposing that the amount of an organic compound prior to the reaction is Y and that the amount of the extracted organic compound is Z, the rate of graft treatment is represented by $((Y-Z)/Y)\times 100(\%)$.

The rate of graft treatment is preferably set to 50% or more. As the surface treatment is carried out more uniformly, the dispersibility is further improved.

The carbon black of the present invention is preferably subjected to a graft treatment with an organic compound that has active free radicals or is capable of producing active free radicals, which will be described later. With this arrangement, it is possible to improve the dispersibility in a medium and also to improve mechanical strength.

(4) Production Method of Carbon Black

The following description will discuss a preferable production method of carbon black in accordance with the present invention.

A preferable production method to be applied to the present invention is provided with at least the following processes:

(A) Surface treatment process, in which the surface of carbon black containing secondary particles made of at least aggregates (structure) of basic particles is treated with an organic compound that has active free radicals or is capable of producing active free radicals; and (B) A process, in which, by applying a mechanical shearing force to the carbon black containing at least secondary particles to give primary particles, and an organic compound is grafted onto a separation face from which the separation is made from the secondary particle.

The following description will discuss the processes (A) and (B) in detail.

(A) The surface treatment process, in which at least the surface of carbon black containing secondary particles made of at least aggregates (structure) of basic particles is treated with an organic compound that has active free radicals or is capable of producing active free radicals.

In this process, the surface of carbon black composed of aggregates (structure) is surface-treated with the above-mentioned organic compound.

In the present process, radicals are generated on the surface of a structure that is the minimum aggregation unit by applying heat or a mechanical force thereon, and the surface treatment is carried out by using an organic compound capable of capturing the radicals. By this process, re-aggregated portions that have been aggregated again by a strong aggregating force between the carbon blacks can be effectively reduced, so that the structure and the primary particles of the carbon black can be prevented from being aggregated and adhered.

The surface treatment includes a process in which an organic compound is adsorbed on the surface and a process in which the organic compound is grafted thereon. In order to stabilize the particles that have been formed into primary particles, the organic compound is preferably grafted onto the entire surface of a secondary particle at portions except for the surface where separation is made from the secondary particle. In order to allow the primary particles to be stably present after the grafting process, which will be described later, it is preferable to graft the organic compound onto the surface of the carbon black in this process.

With respect to the method for the surface treatment, for example, a method in which carbon black aggregates and an organic compound that has active free radicals or is capable of generating active free radicals are mixed with each other may be used. The surface treatment preferably includes a mixing process in which a mechanical shearing force is applied. That is, it is presumed that, in the process in which the mechanical shearing force is applied thereto, the surface of secondary particles of the carbon black is activated, and that the organic compound itself is activated by the shearing force to easily form a radicalized state, with the result that the grafting process of the organic compound onto the surface of the carbon black is easily accelerated.

In the surface treatment process, a device that is capable of applying a mechanical shearing force is preferably used.

The preferable mixing device to be used in the surface treatment process in the present invention includes: a Polylabo System Mixer (Thermo Electron Co., Ltd.), a refiner, a single-screw extruder, a twin-screw extruder, a planetary extruder, a cone-shaped-screw extruder, a continuous kneader, a sealed mixer, a Z-shaped kneader and the like.

When the above-mentioned device is used upon carrying out the surface treatment, the degree of filling of mixture in the mixing zone of the mixing device is preferably set to 80% or more. The degree of filling is found by the following equation:

$$Z=Q/A$$

Z: degree of filling (%) Q: volume of filled matter ($m^2$) A: volume of cavity of mixing section ($m^2$)

In other words, by providing a highly filled state during the mixing process, the mechanical shearing force can be uniformly applied to the entire particles. When the degree of filling is low, the transmission of the shearing force becomes insufficient to fail to accelerate the activity of the carbon black and the organic compound, with the result that the grafting process might hardly progress.

During the mixing process, the temperature of the mixing zone is set to the melting point of the organic compound or more, preferably within the melting point +200° C., more preferably within the melting point +150° C. In the case when a plurality of kinds of organic compounds are mixed, the temperature setting is preferably carried out with respect to the melting point of the organic compound having the highest melting point.

During the mixing process, irradiation of electromagnetic waves, such as ultrasonic waves, microwaves, ultraviolet rays and infrared rays, ozone function, function of an oxidant, chemical function and/or mechanical shearing force function may be used in combination so that the degree of the surface treatment and the process time can be altered. The mixing time is set to 15 seconds to 120 minutes, although it depends on the desired degree of the surface treatment. It is preferably set to 1 to 100 minutes.

The organic compound to be used for the surface treatment is added to 100 parts by weight of carbon black, within the range from 5 to 300 parts by weight, to carry out the surface treatment process. More preferably, it is set to 10 to 200 parts by weight. By adding the organic compound within this range, it is possible to allow the organic compound to uniformly adhere to the surface of the carbon black, and also to supply such a sufficient amount that the organic compound is allowed to adhere to separated faces to be generated at the time when the secondary particles are formed. For this reason, it becomes possible to effectively prevent decomposed primary particles from again aggregating, and also to reduce the possibility of losing inherent characteristics of the carbon black in the finished carbon black, due to an excessive organic compound contained therein when excessively added beyond the above-mentioned amount of addition.

(B) The process in which, by applying a mechanical shearing force to carbon black containing at least secondary particles to give primary particles, and an organic compound is grafted onto separated faces from which the separation is made from the secondary particle.

The present process corresponds to a process in which the carbon black having reduced re-aggregation portions by the surface treatment process is cleaved so that secondary particles are formed into primary particles and the organic compound is grafted onto the surface thereof so that stable primary particles are formed. That is, for example, a mechanical shearing force is applied to the carbon black that has been surface-treated with the organic compound, and while the aggregated portion of basic particles is being cleaved, the organic compound is grafted onto the cleaved portion so that the re-aggregation of the carbon black is suppressed. When the mechanical shearing force is continuously applied to the carbon black, the cleaved portion is expanded, and the organic compound is grafted onto the separated faces caused by the cleavage while being formed into primary particles. Thus, at the time when the separation is finally made to form primary particles, no active portions capable of aggregating are present so that stable primary particles are prepared. In this case, since the same mechanical shearing force is also applied to the added organic compound, the organic compound itself is activated by the mechanical shearing force so that the graft treatment is accelerated.

In the present specification, the term, "carbon black to which an organic compound is grafted" refers to carbon black having a carbon black portion to which an organic compound portion is grafted. Moreover, the term "grafting" means an irreversible addition of an organic compound to a matrix such as carbon black, as defied in "Carbon Black" written by Donnet (Jean-Baptiste Donnet) (published on May 1, 1978, by Kodansha Ltd.).

The above-mentioned grafting process is a process in which an organic compound that has active free radicals or is capable of producing active free radicals is grafted onto at least a cleaved portion; however, the grafting process may be simultaneously carried out at portions other than the cleaved portion. The grafting process may be carried out simultaneously, while the surface treatment process is being executed, or may be carried out as a separated process.

With respect to the means used for causing the cleavage, various methods, which include irradiation of electromagnetic waves, such as ultrasonic waves, microwaves, ultraviolet rays and infrared rays, ozone function, function of an oxidant, chemical function and mechanical shearing function, may be adopted.

In the present invention, the cleavage is preferably caused by applying at least a mechanical shearing force. Carbon black (structure), surface-treated with an organic compound, is placed in a place where a mechanical shearing force is exerted, and the surface-treated carbon black is preferably treated to give primary particles from the structure. Upon applying the mechanical shearing force, any of the above-mentioned methods used for causing the cleavage may be used in combination.

The same shearing force as the mechanical shearing force used in the surface treatment process is preferably used as the mechanical shearing force in this process.

As described above, the function of the mechanical shearing force is used not only for forming carbon black into fine particles from aggregates to primary particles, but also for cutting chains inside the carbon black to generate active free radicals. The organic compound, which is used in the present invention, and has free radicals or is capable of generating free radicals, includes, for example, an organic compound that is divided by receiving, for example, a function of the field of the mechanical shearing force to be allowed to have or generate active free radicals. In the case when the active free radicals are not sufficiently generated only by the function of the mechanical shearing force, the number of the active free radicals may be compensated for, by using irradiation with electromagnetic waves, such as ultrasonic waves, microwaves, ultraviolet rays and infrared rays, function of ozone or function of an oxidant.

With respect to the device for applying the mechanical shearing force, for example, the following devices may be used: a Polylabo System Mixer (Thermo Electron Co., Ltd.), a refiner, a single-screw extruder, a twin-screw extruder, a planetary extruder, a cone-shaped-screw extruder, a continuous kneader, a sealed mixer and a Z-shaped kneader. With respect to the conditions under which the mechanical shearing force is applied, the same conditions as those in the aforementioned surface treatment process are preferably used from the viewpoint of effectively applying the mechanical shearing force. By using these devices, the mechanical energy is uniformly applied to the entire particles effectively as well as continuously so that the grafting process can be preferably carried out effectively as well as uniformly.

In the above-mentioned surface treatment process and grafting process, the organic compound to be added may be gradually added continuously or intermittently so as to be set to a predetermined amount thereof, or a predetermined amount thereof may be added at the initial stage of the surface treatment process, and processes up to the grafting process may be executed.

With respect to the organic compound to be used for the surface treatment process as a material for the surface treatment and the organic compound to be used for the grafting process as a material to be graft-reacted, the same compounds may be used, or different compounds may be used.

The above-mentioned grafting process is preferably carried out under the condition of the melting point of the used organic compound or more. The upper limit of the temperature condition is preferably set, in particular, within the melting point +200° C., more preferably within the melting point +150° C. from the viewpoints of accelerating the grafting reaction and the division into primary particles. In the case when a plurality of kinds of organic compounds are mixed, it is preferable to carry out the temperature setting with respect to the melting point of the organic compound having the highest melting point.

The period of time during which the mechanical shearing force is applied is preferably set within the range from 1 to 100 minutes so as to sufficiently execute the process, from the viewpoint of improving the homogeneity of the reaction.

In the above-mentioned production method, the mechanical shearing force is preferably applied thereto by mixing carbon black and an organic compound that will be described later, without using a solvent. Since the shearing force is applied at a temperature of the melting temperature of the organic compound or more during the reaction, the organic compound is formed into a liquid state and well attached to the surface of the carbon black that is a solid substance uniformly so that the reaction is allowed to proceed effectively. In the case when a solvent is used, although the homogeneity is improved, the transmission of energy is lowered upon applying the mechanical shearing force to cause a low level of activation, with the result that it presumably becomes difficult to effectively carry out the grafting process.

The method of adjusting the amount of primary particles is not particularly limited, but the amount can be adjusted by modifying the condition for applying the mechanical shearing force described above. More specifically, it is possible to modify the mechanical shearing force and adjust the content of primary particles by adjusting the filling degree of the mixture in the mixing zone of the mixer for application of shearing force to 80% or more and further altering the filling degree. It is also possible to adjust the content by altering the agitation torque during mixing and to control the torque by adjusting the filling degree described above and also the rotational frequency and temperature for agitation. More specifically, decrease of agitation temperature leads to increase in viscosity of the organic compound in the melted state and in torque of agitation, and consequently to increase in shearing force, i.e., increase in primary particle content.

2) Carbon Black as Starting Material

Examples of an applicable carbon black include furnace black, channel black, acetylene black, Lamp Black, and the like and any of these are commercially available and carbon blacks having an aggregate structure. This aggregate structure has "a structure constitution" formed with primary particles or basic particles aggregated, which means a so-called carbon black formed into secondary particles, made of an aggregate of the primary particles. In order to smoothly carry out the surface treatment and grafting reaction of an organic compound onto carbon black, sufficient amounts of oxygen-containing functional groups, such as a carboxyl group, a quinone group, a phenol group and a lactone group, and active hydrogen atoms on the layer face peripheral edge, are preferably placed on the surface of the carbon black. For this reason, the carbon black to be used in the present invention is preferably allowed to have an oxygen content of 0.1% or more and a hydrogen content of 0.2% or more. In particular, the oxygen content is 10% or less and the hydrogen content is 1% or less. Each of the oxygen content and the hydrogen content is found as a value obtained by dividing the number of oxygen elements or hydrogen elements by the total number of elements (sum of carbon, oxygen and hydrogen elements).

By selecting these ranges, it is possible to smoothly carry out the surface treatment and grafting reaction of an organic compound onto carbon black.

By selecting the above-mentioned ranges, an organic compound that has free radicals or is capable of generating free radicals is certainly grafted onto carbon black so that the re-aggregation preventive effect can be improved. In the case when the oxygen content and hydrogen content of the carbon black surface are smaller than the above-mentioned ranges, a gaseous phase oxidizing process, such as a heated air oxidization and an ozone oxidization, or a liquid phase oxidizing process by the use of nitric acid, hydrogen peroxide, potassium permanganate, sodium hypochlorite, or bromine water, may be used to increase the oxygen content and the hydrogen content of the carbon black.

3) Organic Compound

An organic compound to be used for surface-treating carbon black in the surface treatment, or to be grafted onto carbon black in the grafting process, corresponds to an organic compound that has free radicals or is capable of generating free radicals.

In the organic compound that is capable of generating free radicals, although not particularly limited, the condition for generating free radicals requires a state in which the organic compound possesses free radicals during the grafting process, in the case of the organic compound to be used in the present invention. With respect to the organic compound, a compound capable of generating free radicals by at least electron movements, a compound capable of generating free radicals through thermal decomposition and a compound capable of generating free radicals derived from cleavage of the compound structure due to a shearing force or the like, may be preferably used.

With respect to the organic compound that has free radicals or is capable of generating free radicals to be used in the present invention, its molecular weight is preferably 50 or more, and the upper limit is preferably 1500 or less. By adopting the organic compound having a molecular weight within this range, it is possible to form carbon black whose surface is substituted by an organic compound having a high molecular weight to a certain degree, and consequently to restrain the resulting primary particles from being re-aggregated. By using the organic compound having a molecular weight of 1500 or less, an excessive surface modification can be avoided, and the characteristics of the organic compound grafted onto the surface are prevented from being excessively exerted; thus, it becomes possible to sufficiently exert the characteristics of the carbon black itself.

With respect to the organic compound to be used for the surface treatment process and the organic compound to be used for the grafting process, the same compound may be used, or different compounds may be used, and a plurality of kinds of organic compounds may be added to the respective processes. In order to control the reaction temperatures and simplify the other conditions, the same organic compound is preferably used for the surface treatment process as well as for the grafting process.

Examples of the organic compound include organic compounds that can capture free radicals on the surface of carbon black, such as a phenol-based compound, an amine-based compound, a phosphate-based compound and a thioether-based compound.

So-called antioxidants and photostabilizers are preferably used as these organic compounds. More preferably, hindered-phenol based ones and hindered-amine based ones may be used. Those antioxidants of phosphate ester-based compounds, thiol-based compounds and thioether-based compounds may also be used. A plurality of these organic compounds may be used in combination. Depending on the combinations thereof, various characteristics for the surface treatment can be exerted.

In order to positively control the reaction, these organic compounds are preferably the ones not having an isocyanate group. That is, in the case when an organic compound having an excessive reactivity is used, it becomes difficult to provide a uniform grafting reaction, sometimes resulting in a prolonged reaction time and a large quantity of the organic compound to be used. Although not clearly confirmed, the reason for this is presumably because in the case of using an organic compound having a high reactivity as described above, the reaction tends to progress at points other than the surface active points, with the result that the reaction to the active points formed by the mechanical shearing force, which is an original object, becomes insufficient.

Specific examples of the organic compound are shown below:

Phenol-Based Compounds (Organic Compounds 1 to 88)

(Organic compound 1)

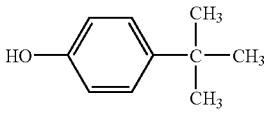

(Organic compound 2)

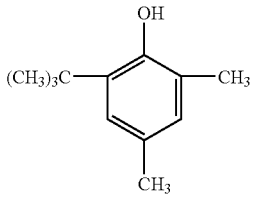

-continued
(Organic compound 3)
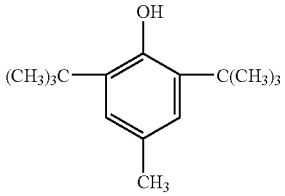
(Organic compound 4)
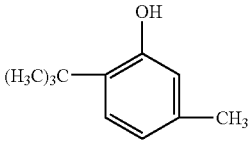
(Organic compound 5)
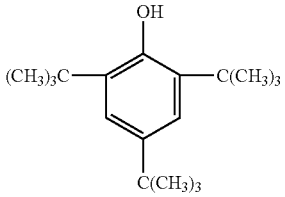
(Organic compound 6)
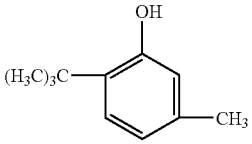
(Organic compound 7)
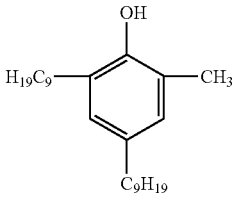
(Organic compound 8)
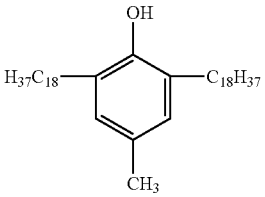
(Organic compound 9)
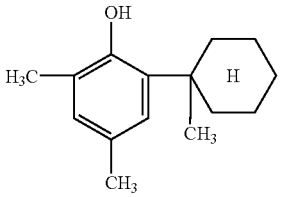
(Organic compound 10)
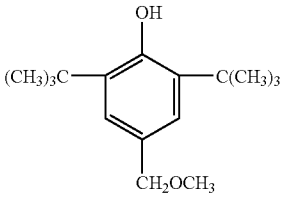
(Organic compound 11)
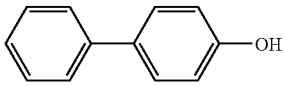
(Organic compound 12)
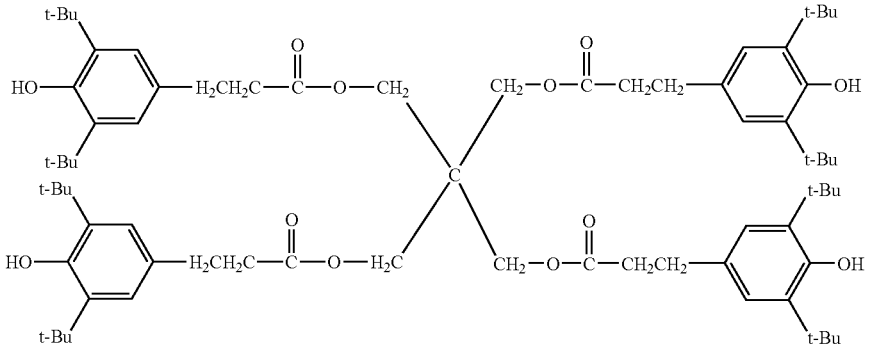
(Organic compound 13)
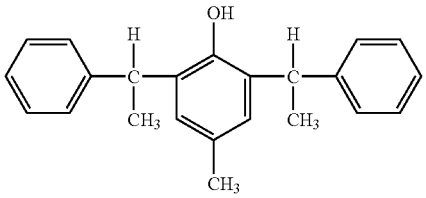
(Organic compound 14)
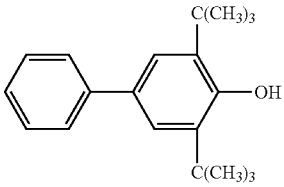

-continued
(Organic compound 15)
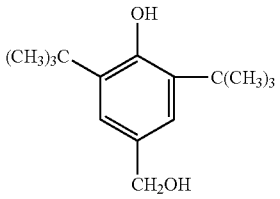
(Organic compound 16)
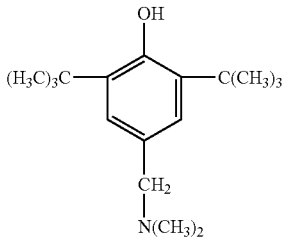
(Organic compound 17)
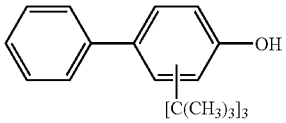
(Organic compound 18)
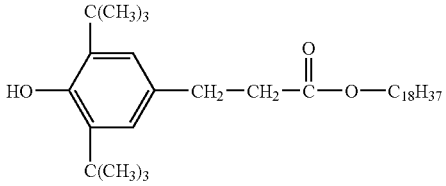
(Organic compound 19)
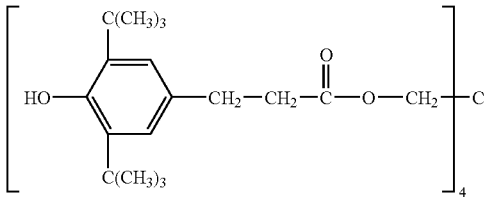
(Organic compound 20)
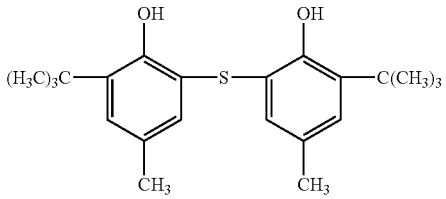
(Organic compound 21)
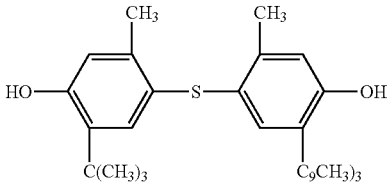
(Organic compound 22)
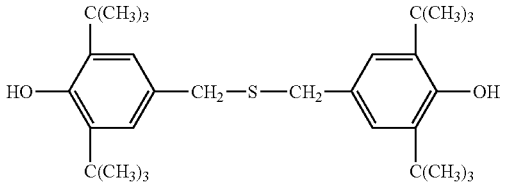
(Organic compound 23)
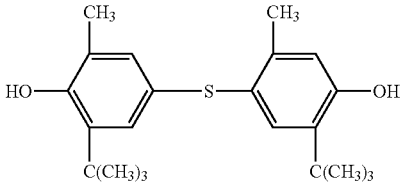
(Organic compound 24)
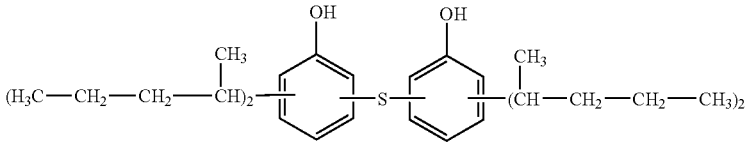
(Organic compound 25)
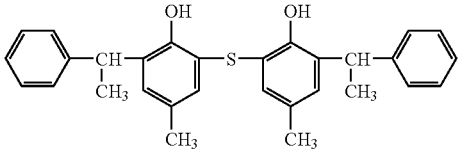
(Organic compound 26)
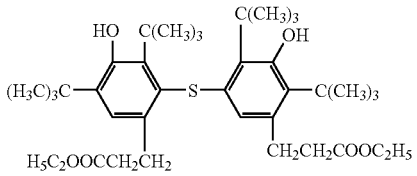

-continued
(Organic compound 27)
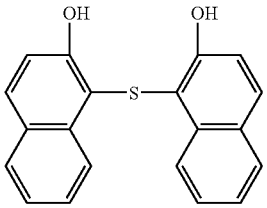
(Organic compound 28)
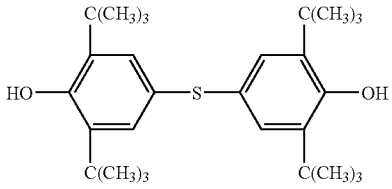
(Organic compound 29)
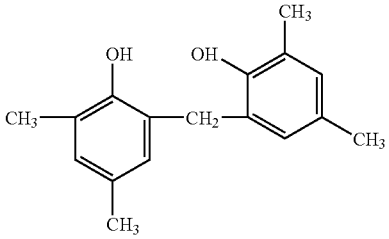
(Organic compound 30)
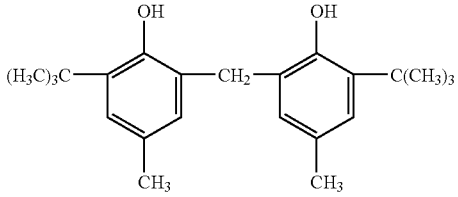
(Organic compound 31)
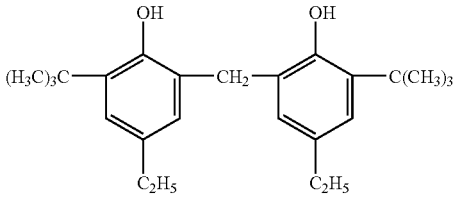
(Organic compound 32)
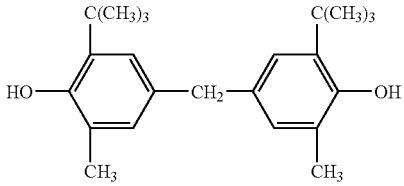
(Organic compound 33)
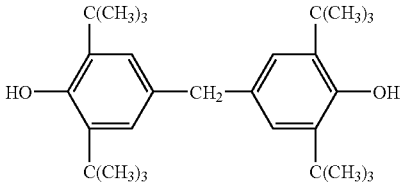
(Organic compound 34)
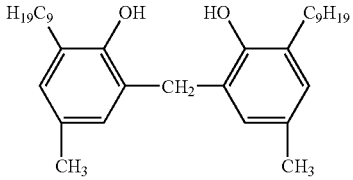
(Organic compound 35)
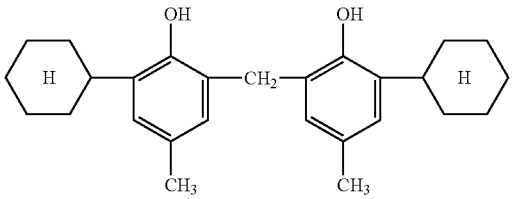
(Organiccompound 36)
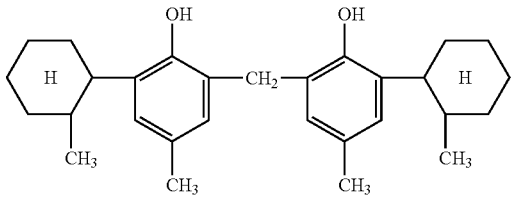
(Organic compound 37)
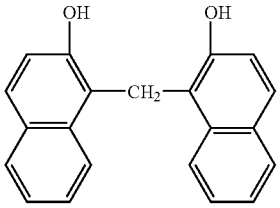
(Organic compound 38)
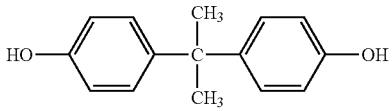
(Organic compound 39)
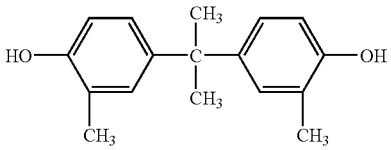
(Organic compound 40)
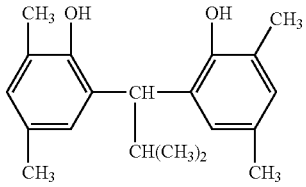

-continued
(Organic compound 41)
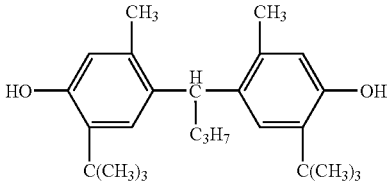
(Organic compound 42)
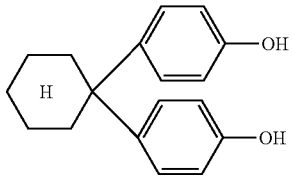
(Organic compound 43)
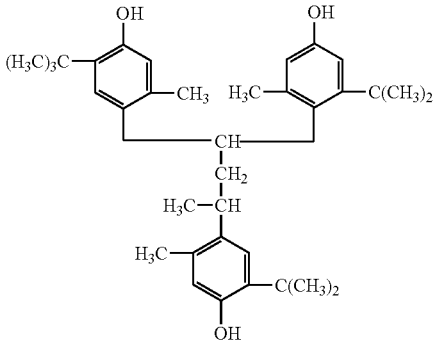
(Organic compound 44)
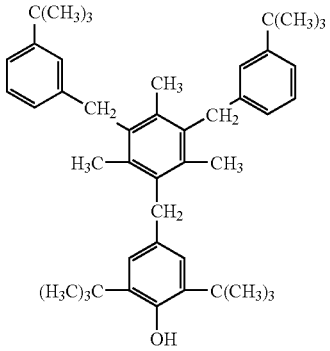
(Organic compound 45)
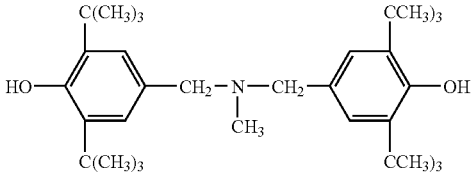
(Organic compound 46)
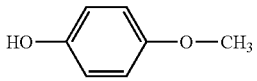
(Organic compound 47)
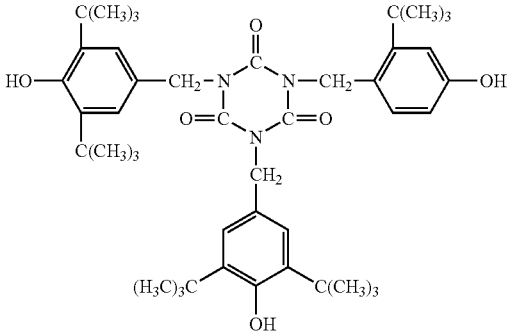
(Organic compound 48)
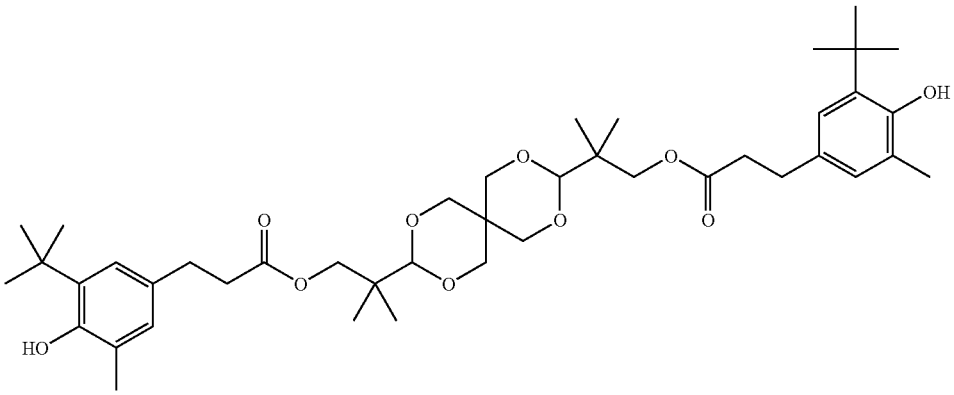

-continued
(Organic compound 49)
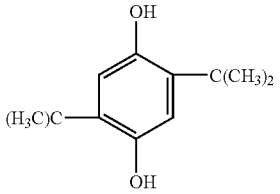
(Organic compound 50)
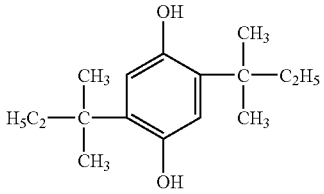
(Organic compound 51)
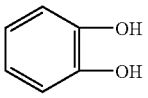
(Organic compound 52)
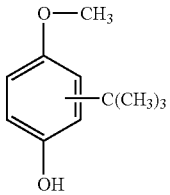
(Organic compound 53)
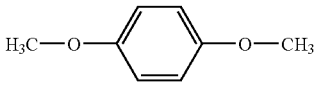
(Organic compound 54)
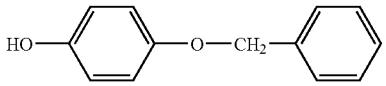
(Organic compound 55)
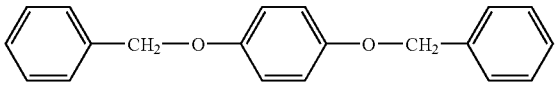
(Organic compound 56)
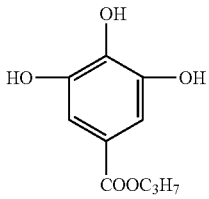
(Organic compound 57)
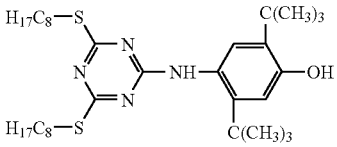
(Organic compound 58)
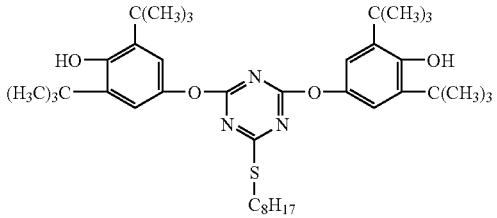
(Organic compound 59)
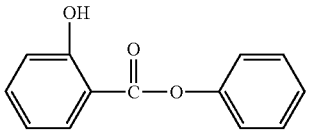
(Organic compound 60)
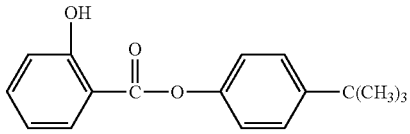
(Organic compound 61)
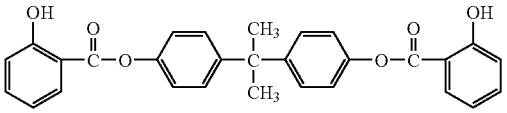
(Organic compound 62)
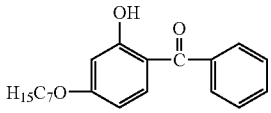
(Organic compound 63)
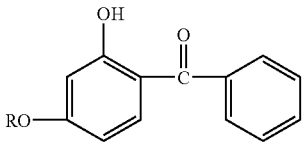
$R = C_9H_{19}$
(Organic compound 64)
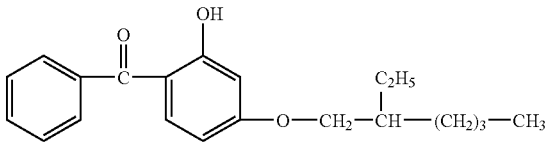

-continued
(Organic compound 65)
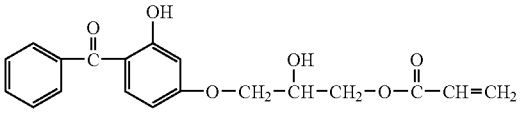
(Organic compound 66)
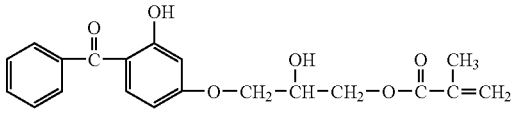
(Organic compound 67)
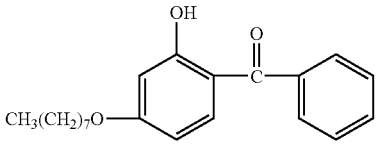
(Organic compound 68)
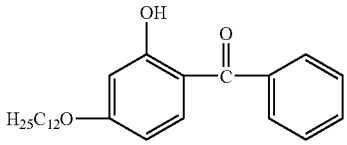
(Organic compound 69)
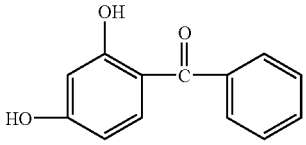
(Organic compound 70)
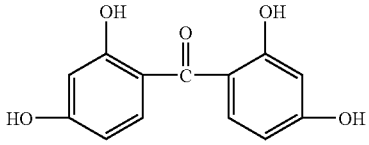
(Organic compound 71)
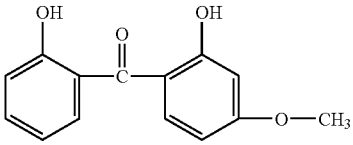
(Organic compound 72)
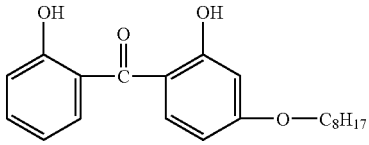
(Organic compound 73)
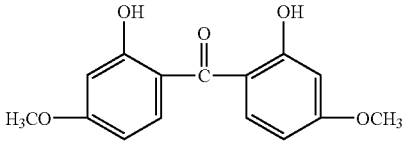
(Organic compound 74)
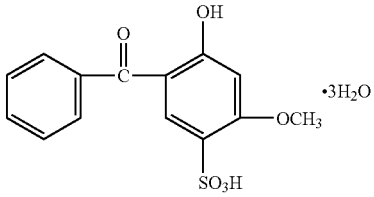
(Organic compound 75)
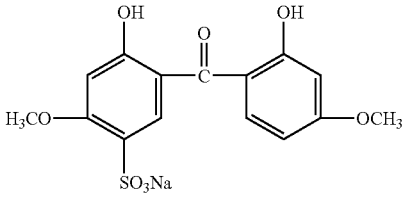
(Organic compound 76)
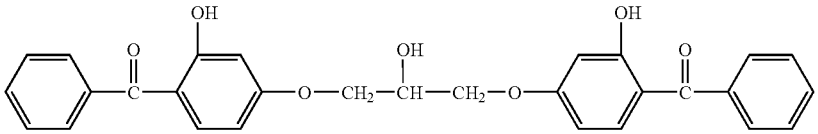
(Organic compound 77)
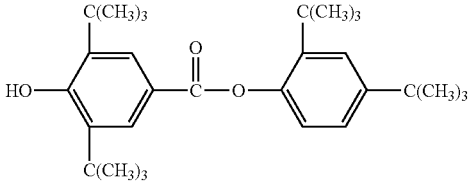
(Organic compound 78)
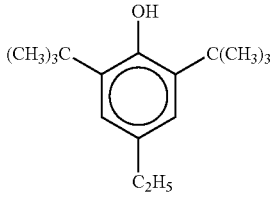

-continued
(Organic compound 79)
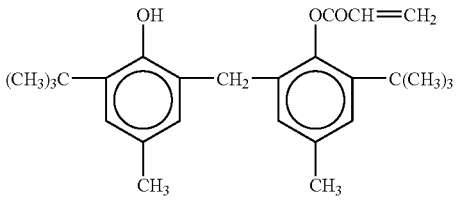
(Organic compound 80)
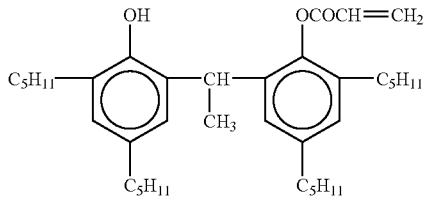
(Organic compound 81)
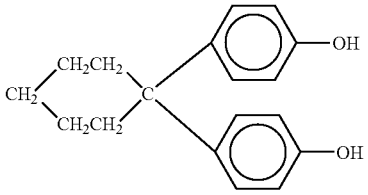
(Organic compound 82)
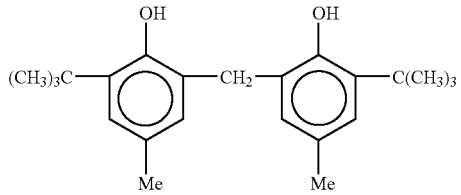
(Organic compound 83)
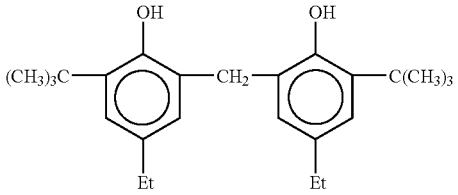
(Organic compound 84)
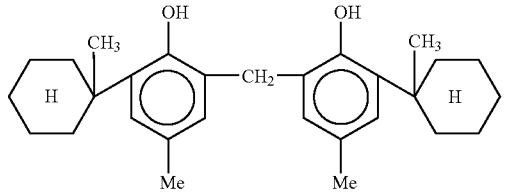
(Organic compound 85)
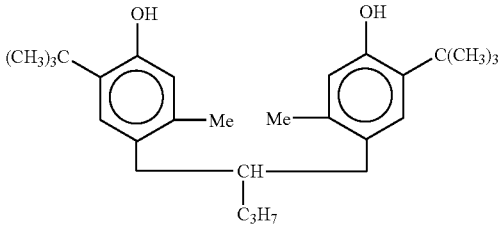
(Organic compound 86)
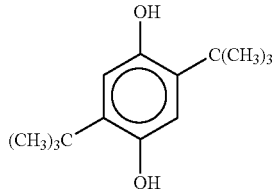
(Organic compound 87)
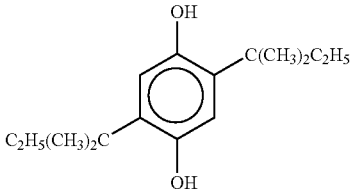
(Organic compound 88)
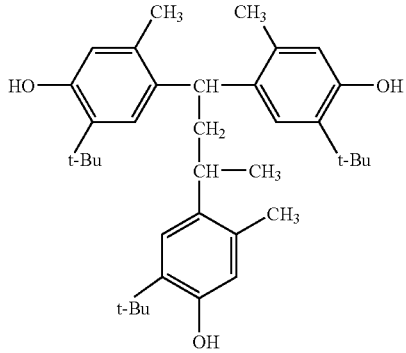

Amine-Based Compounds (Organic Compounds 89 to 144)

(Organic compound 89)

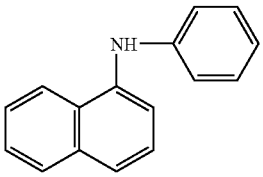

(Organic compound 90)

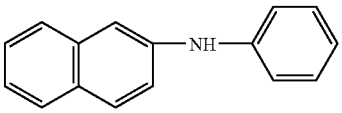

(Organic compound 91)

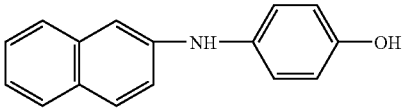

(Organic compound 92)

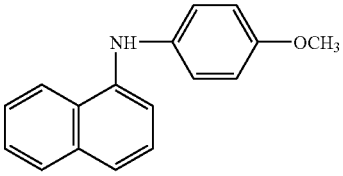

(Organic compound 93)

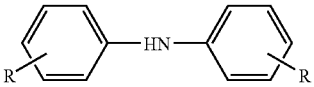

R = $C_7H_{15}$ (Organic compound 94)

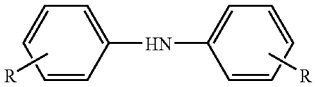

R = $C_8H_{17}$ (Organic compound 95)

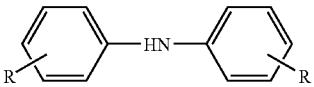

R = $C_9H_{19}$ (Organic compound 96)

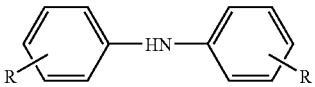

R = $C_{10}H_{21}$ (Organic compound 97)

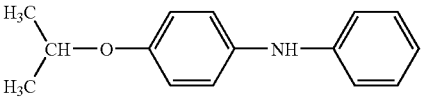

(Organic compound 98)

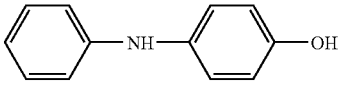

(Organic compound 99)

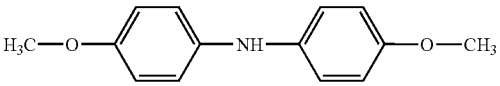

(Organic compound 100)

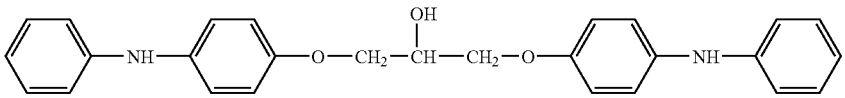

(Organic compound 101)

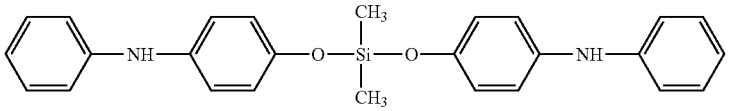

(Organic compound 102)

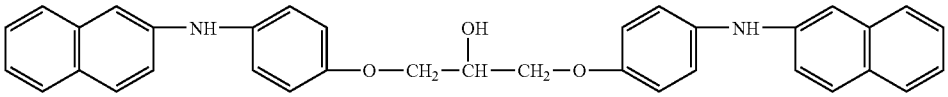

(Organic compound 103)

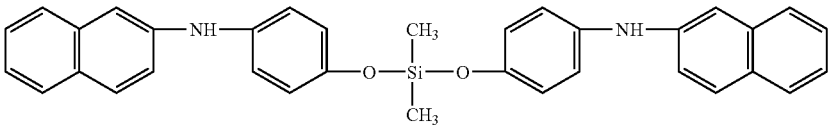

(Organic compound 104)

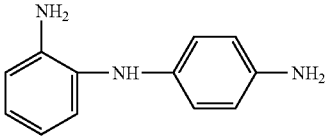

(Organic compound 105)

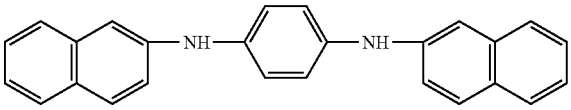

-continued (Organic compound 106)

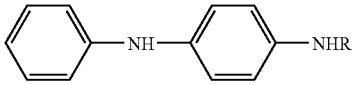

R = $C_7H_{15}$ (Organic compound 107)

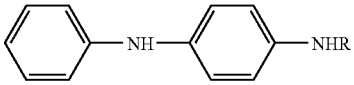

R = $C_8H_{17}$ (Organic compound 108)

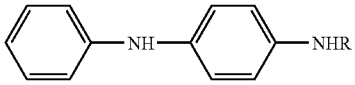

R = $C_9H_{19}$ (Organic compound 109)

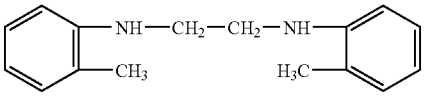

(Organic compound 110)

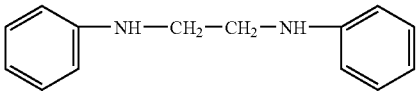

(Organic compound 111)

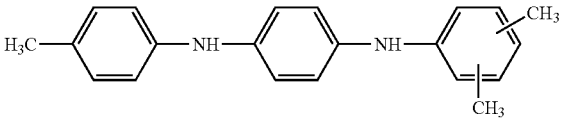

(Organic compound 112)

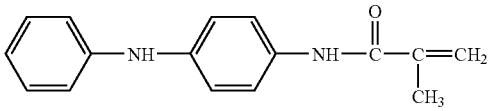

(Organic compound 113)

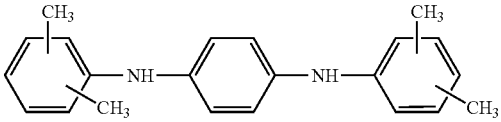

(Organic compound 114)

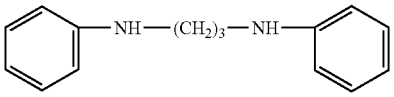

(Organic compound 115)

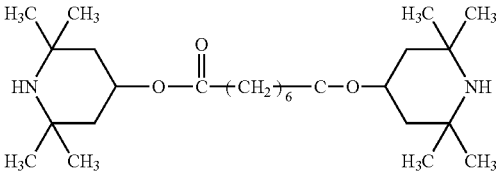

(Organic compound 116)

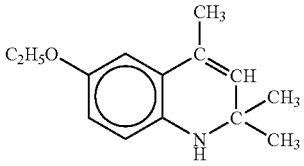

(Organic compound 117)

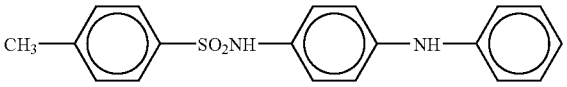

(Organic compound 118)

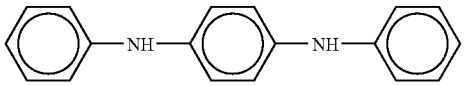

(Organic compound 119)

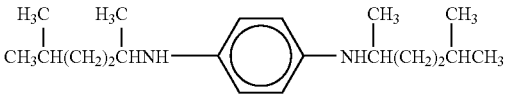

(Organic compound 120)

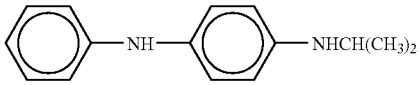

(Organic compound 121)

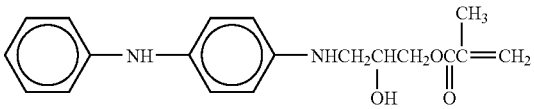

(Organic compound 122)

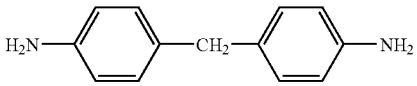

(Organic compound 123)

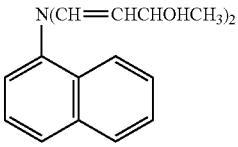

(Organic compound 124)

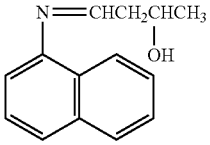

(Organic compound 125)

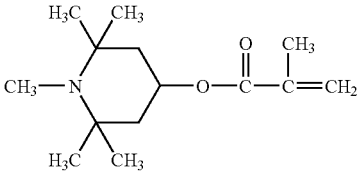

-continued
(Organic compound 126)
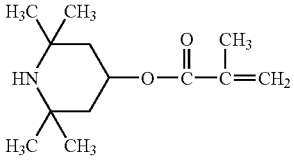
(Organic compound 127)
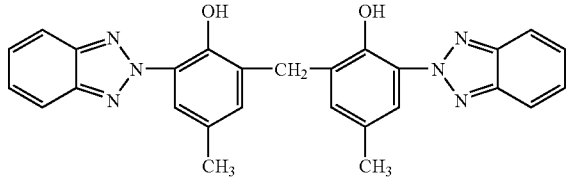
(Organic compound 128)
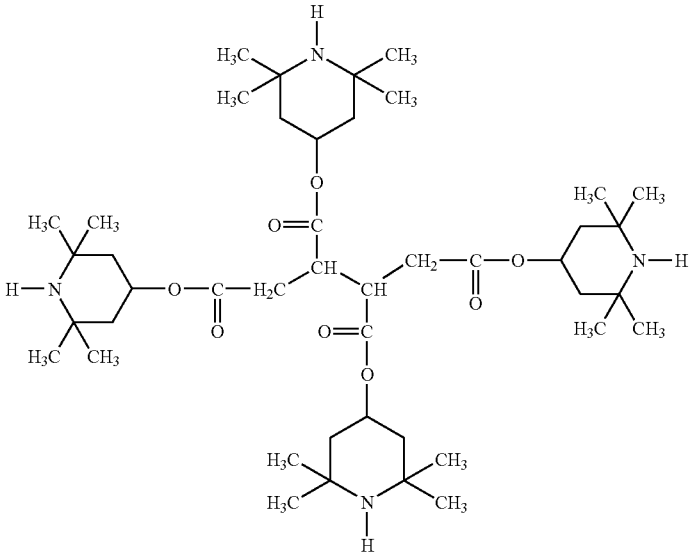
(Organic compound 129)
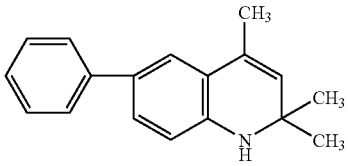
(Organic compound 130)
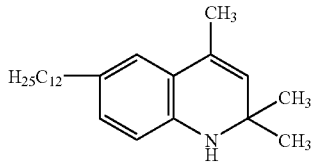
(Organic compound 131)
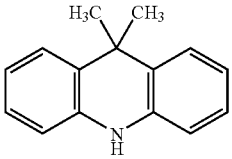
(Organic compound 132)
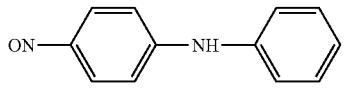
(Organic compound 133)
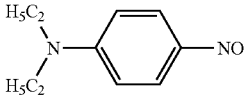
(Organic compound 134)
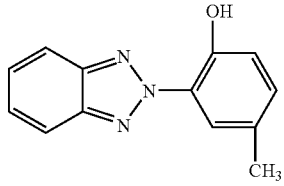
(Organic compound 135)
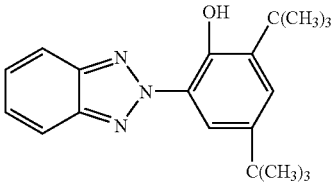
(Organic compound 136)
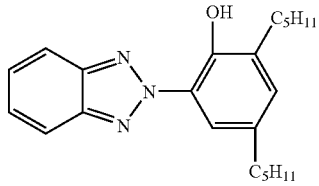

-continued
(Organic compound 137)
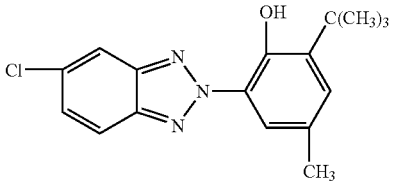
(Organic compound 138)
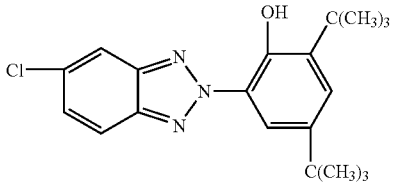
(Organic compound 139)
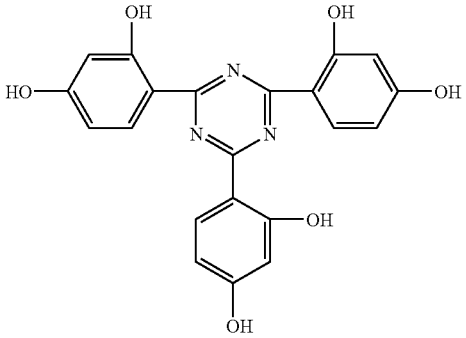
(Organic compound 140)
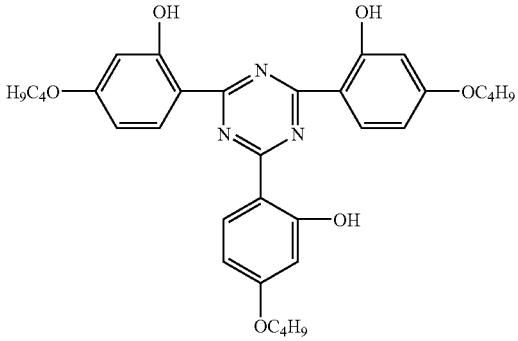
(Organic compound 141)
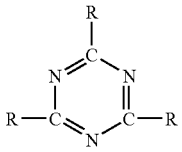
R = —$NHC_5H_4NHC_6H_5$, —$OC_6H_4NHC_6H_5$
(Organic compound 142)
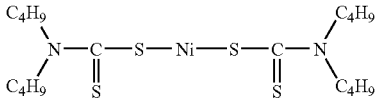
(Organic compound 143)
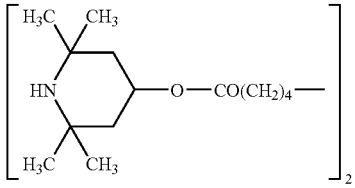
(Organic compound 144)
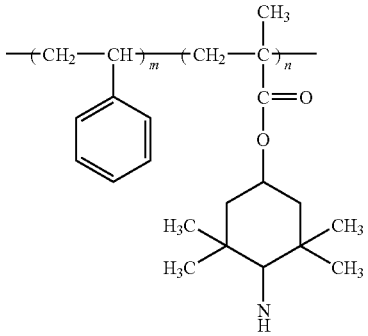
Thiol-Based and Thioether-Based Compounds
(Organic Compounds 145 to 153)
(Organic compound 145)
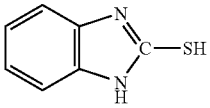
(Organic compound 146)
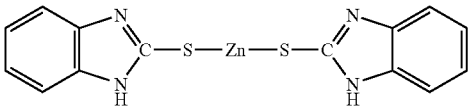
-continued
(Organic compound 147)
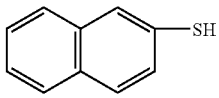
(Organic compound 148)
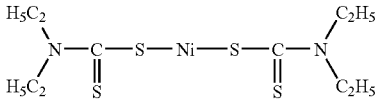
(Organic compound 149)
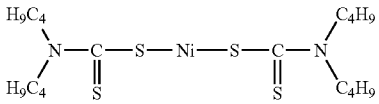

-continued (Organic compound 150)

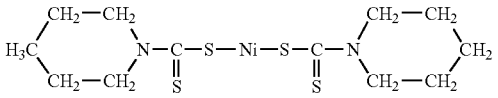

(Organic compound 151)

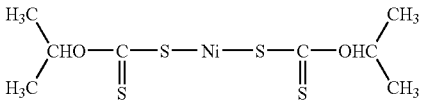

(Organic compound 152)

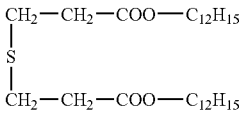

(Organic compound 153)

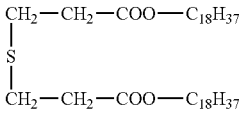

Phosphate Ester-Based Compounds (Organic Compounds 154 to 160)

(Organic compound 154)

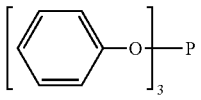

(Organic compound 155)

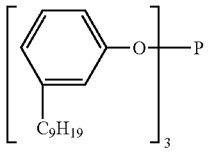

(Organic compound 156)

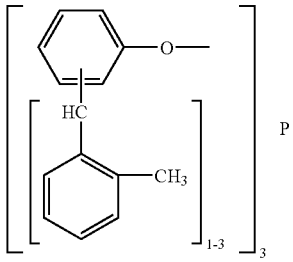

(Organic compound 157)

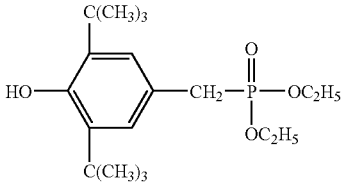

-continued (Organic compound 158)

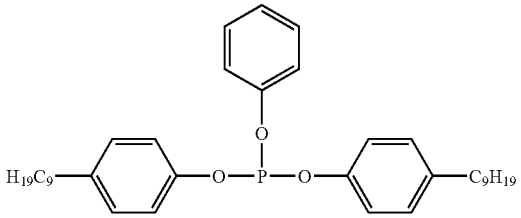

(Organic compound 159)

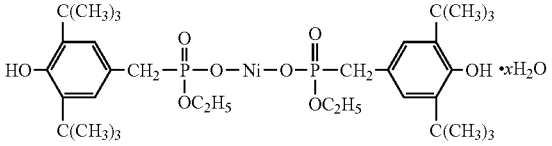

(Organic compound 160)

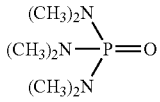

Phenol-Based Organic Compound (Organic compound 161)

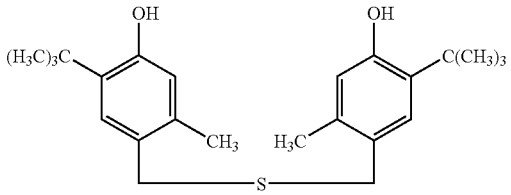

BEST MODE FOR CARRYING OUT THE INVENTION

Hereinafter, embodiments of the present invention will be described in detail.

(Basic Configuration of Intermediate Transfer Belt)

The intermediate transfer belt 200 in the present embodiment is an endless belt used as wound around multiple rollers, as shown in FIG. 4, and has a two-layer structure consisting of a base semiconductive film 201 and an anti-toner-filming layer 202 formed on the external surface of the base material 201. The base semiconductive film 201 has, for example, a volume resistivity of $10^6$ to $10^{12}$ Ω·cm, and is prepared, for example, by dispersing a conductive additive such as carbon black in an engineering plastic resin such as modified polyimide, heat-hardening polyimide, ethylene tetrafluoroethylene copolymer, polyfluorovinylidene, or nylon alloy, and the thickness thereof is 0.1 to 1.0 mm. The anti-toner-filming layer 202 is, for example, a fluorine-based coating film having a thickness of 5 to 50 μm. A semiconductive rubber belt having a thickness of 0.5 to 2.0 mm obtained by dispersing a conductive material in a rubber such as silicone or polyurethane rubber may also be used as the base belt material 201.

(Preparation of Intermediate Transfer Belt)

The intermediate transfer belt is produced, for example, by centrifugal casting or extrusion molding. Hereinafter, the extrusion molding method used in the Examples and Comparative Examples below will be described with reference to FIG. 5. In FIG. 5, the seamless belt-producing device 510 has a molding mold 511, a gear pump 515 connected to the resin injection port 512 of a molding mold 511, an extruder 514, a sizing mold 517 placed at a position below the outlet of the molding mold 511, a withdrawing machine 518 withdrawing the cylindrical film F, and a cutting machine 519.

A resin fed from the material inlet 516 of the extruder 514 is mixed under agitation in the extruder 514 and melt-extruded under heat, and the extruded melted resin is fed further by a gear pump 515 via the resin injection port 512 into the molding mold 511.

The melted resin fed into the molding mold 511 flows as diffused through the opening between the internal and outside mandrels of the molding mold 511 and goes out of the molding mold 511 continuously as a cylindrical film F in the melted state. The cylindrical film F continuously coming out of the molding mold 511 in the melted state is withdrawn by conveyor belts 518*a* of the withdrawing machine 518 placed below the outlet of the molding mold 511 along the external peripheral surface of the sizing mold 517. The film is solidified as cooled along the external peripheral surface of sizing mold 517 into a film having a particular peripheral length and thickness. The film is then cut into round slices of a particular size by using the cutting machine 519, to give a seamless belt.

The molding mold 511 is configured to be heated to a particular temperature, while a band heater is wound around the peripheral surface. The sizing mold 517, which has an internal channel for circulation of cooling water, is kept to a temperature of approximately 80° C. by circulation of cooling water, to cool the cylindrical film F coming out of the molding mold 511 continuously in the melted state.

The seamless belt-producing device described above is designed to withstand continuous processing at a processing temperature of about 10° C. higher than the resin melting temperature, and the seamless belt is produced by extruding the resin material described above at a temperature of 280° C. or higher in the seamless belt-producing device.

[Production of Carbon Black]

(Carbon Black #1)

To 100 parts by weight of carbon black (N220, made by Mitsubishi Chemical Co., Ltd.; number average particle size of Feret's diameter=210 nm) was added 50 parts by weight of an organic compound 48 (molecular weight=741, melting point=125° C.), and this was charged into a twin-screw extruder. This twin-screw extruder have two screws so as to carry out a mixing process, and a PCM-30 (made by Ikegai Corporation) is used. This extruder is not designed to carry out a continuous kneading process, but modified so as to carry out a stirring process by two screws with the outlet being sealed. After charging the two components into the device so as to have a degree of filling of 94%, a stirring process was carried out thereon in a heated state to a first temperature (Tp1) 160° C. (melting point+35° C.).

With respect to the stirring conditions, a first stirring velocity (Sv1) was set to 30 screw revolutions per minute, with a first processing time (T1) being set to 10 minutes; thus, the stirring process was carried out. After the stirring process, the stirred matter was sampled, and the grafted state was confirmed by using a Soxhlet extractor so that a grafted rate of about 30% was obtained. That is, it was confirmed that a grafting process was progressing on the surface of carbon black.

Then, with respect to the stirring conditions of a mixing device, a second stirring velocity (Sv2) was set to 50 screw revolutions per minute, with a second temperature (Tp2) being set to 180° C. (melting point+55° C.), so that the conditions were changed so as to provide a higher mechanical shearing force; thus, the stirring process was carried out for 60 minutes as a second processing time (T2). Thereafter, the stirred matter was cooled, and the processed carbon black was taken out. The above-mentioned organic compound was grafted onto the surface of the carbon black at a grafted rate of 91%. Here, the primary particles were present thereon at 91% on a number basis. The carbon black had a number average particle size of Feret's diameter of 42 nm. This carbon black is referred to as "carbon black #1."

[Carbon Blacks #2 to #4]

The same processes as those of carbon black #1 were carried out except that the production conditions were changed as shown in Tables 1 and 2 so that carbon blacks #2, #3 and #4 were obtained.

[Carbon Black #5]

To 100 parts by weight of carbon black (N220, made by Mitsubishi Chemical Co., Ltd.) was added 80 parts by weight of an organic compound 47 (molecular weight=784, melting point=221° C.), and this was charged into a batch-type twin-screw extruder used in Example 1 so as to have a degree of filling of 94%. Next, a stirring process was carried out thereon in a heated state to 240° C. (melting point+19° C.) (Tp1). In the stirring process, the stirring velocity (Sv1) was set to 35 screw revolutions per minute, and the stirring process was carried out for 15 minutes (T1). After the stirring process, the stirred matter was sampled, and the grafted state was confirmed by using a Soxhlet extractor so that a grafted rate of about 32% was obtained. That is, it was confirmed that a grafting process was progressing on the surface of carbon black. Next, with respect to the stirring conditions of a mixing device, the stirring velocity (Sv2) was set to 55 screw revolutions per minute, with the heating temperature (the second temperature Tp2) being set to 270° C. (melting point+49° C.), so that the conditions were changed so as to provide a higher mechanical shearing force; thus, the stirring process was carried out for 70 minutes as the processing time (T2). Thereafter, the stirred matter was cooled, and the processed carbon black was taken out. The above-mentioned organic compound was grafted onto the surface of the carbon black at a grafted rate of 72%. The primary particles were present thereon at 53% on a number basis. Moreover, the carbon black had a number average particle size of Feret's diameter of 48 nm. This carbon black is referred to as "carbon black #5."

[Carbon Blacks #6 to #9]

The same processes as those of carbon black #1 were carried out except that the production conditions were changed as shown in Tables 1 and 2 so that carbon blacks #6 to #9 were obtained.

[Carbon Black #10]

The same processes as those of carbon black #1 were carried out except that in place of carbon black (N220, made by Mitsubishi Chemical Co., Ltd.), Raven 1035 (made by Columbia Chemical Co., Ltd.) was used and that the other conditions were changed as shown in Tables 1 and 2 so that carbon black #10 was obtained.

[Carbon Black #11]

The same processes as those of carbon black #5 were carried out except that in place of carbon black (N220, made by Mitsubishi Chemical Co., Ltd.), Raven 1035 (made by Columbia Chemical Co., Ltd.) was used and that the other conditions were changed as shown in Tables 1 and 2 so that carbon black #11 was obtained.

[Carbon Blacks #12 to #13]

The same processes as those of carbon black #1 were carried out except that the production conditions were changed as shown in Tables 1 and 2 so that carbon blacks #12 and #13 were obtained.

[Carbon Black #14]

Carbon black (N220, made by Mitsubishi Chemical Co., Ltd.) that had not been subjected to the surface treatment and the grafting process was defined as "carbon black #14."

[Carbon Black #15]

In carbon black #1, after a lapse of the first processing time (T1) of one minute, a sample was taken out. This sample was defined as "carbon black #15."

[Carbon Black #16]

The same processes as those of carbon black #1 were carried out except that the organic compound was changed to stearic acid (molecular weight=284, melting point=70° C.) (comparative compound 1) that would generate no free radicals. This was defined as "carbon black #16."

[Carbon Black #17]

The same processes as those in the carbon black #16 were carried out except that the carbon black was changed to another carbon black having a number average particle size of Feret's diameter of 500 μm.

To 100 parts of the carbon black 1 was added and mixed 155 parts of the processed carbon black so that carbon black having a number average particle size of Feret's diameter of 320 μm and a number rate of primary particles of 26% was obtained. This was defined as carbon black #17.

With respect to each of the carbon blacks 1 to 17, a number average particle size of Feret's diameter thereof and a number rate of primary particles were shown in Table 3.

TABLE 1

| Carbon black number | Organic compound Number | Melting point (° C.) | Molecular weight | Added amount (parts) | First temperature Tp1 (° C.) | Difference from melting point of organic compound (° C.) | Degree of filling (%) | First stirring velocity (number of revolutions/min) Sv1 | First processing time (minute) T1 | Grafted rate (%) |
|---|---|---|---|---|---|---|---|---|---|---|
| 1 | 48 | 125 | 741 | 50 | 160 | +35 | 94 | 30 | 10 | 30 |
| 2 | 48 | 125 | 741 | 50 | 150 | +25 | 98 | 30 | 10 | 25 |
| 3 | 48 | 125 | 741 | 50 | 150 | +25 | 98 | 30 | 10 | 25 |
| 4 | 48 | 125 | 741 | 50 | 150 | +25 | 98 | 40 | 10 | 40 |
| 5 | 47 | 221 | 784 | 80 | 240 | +19 | 94 | 35 | 15 | 32 |
| 6 | 88 | 186 | 545 | 50 | 216 | +30 | 98 | 35 | 15 | 35 |
| 7 | 115 | 84 | 481 | 50 | 104 | +20 | 97 | 30 | 5 | 32 |
| 8 | 127 | 195 | 659 | 50 | 215 | +20 | 98 | 35 | 5 | 36 |
| 9 | 128 | 132 | 791 | 50 | 145 | +13 | 91 | 30 | 5 | 26 |
| 10 | 48 | 125 | 741 | 50 | 150 | +25 | 94 | 30 | 10 | 33 |
| 11 | 47 | 221 | 784 | 80 | 231 | +10 | 98 | 30 | 10 | 35 |
| 12 | 48 | 125 | 741 | 50 | 160 | +35 | 94 | 30 | 10 | 30 |
| 13 | 48 | 125 | 741 | 50 | 150 | +25 | 98 | 30 | 5 | 15 |
| 14 | なし | — | — | — | — | — | — | — | — | — |
| 15 | 48 | 125 | 741 | 50 | 150 | +25 | 94 | 30 | 1 | 2 |
| 16 | Comparative compound 1 | 70 | 284 | 50 | 105 | +35 | 94 | 30 | 10 | 0 |
| 17 | Comparative compound 1 | 70 | 284 | 50 | 105 | +35 | 94 | 30 | 10 | 0 |

TABLE 2

| Carbon black number | Second temperature condition Tp2 (° C.) | Difference from melting point of organic compound (° C.) | Second stirring velocity (number of revolutions/min) Sv2 | Processing time (minute) T2 | Grafted rate (%) |
|---|---|---|---|---|---|
| 1 | 180 | +55 | 50 | 60 | 91 |
| 2 | 190 | +65 | 55 | 60 | 93 |
| 3 | 220 | +95 | 60 | 60 | 95 |
| 4 | 220 | +65 | 65 | 60 | 97 |
| 5 | 270 | +49 | 55 | 70 | 72 |
| 6 | 266 | +80 | 60 | 70 | 83 |
| 7 | 174 | +90 | 55 | 40 | 93 |
| 8 | 265 | +70 | 50 | 60 | 94 |
| 9 | 210 | +78 | 50 | 40 | 91 |
| 10 | 190 | +65 | 60 | 40 | 94 |
| 11 | 250 | +29 | 55 | 40 | 90 |
| 12 | 180 | +55 | 50 | 40 | 65 |
| 13 | 190 | +65 | 55 | 10 | 35 |
| 14 | — | — | — | — | — |
| 15 | — | — | — | — | 2 |
| 16 | 125 | +55 | 50 | 30 | 0 |
| 17 | 125 | +55 | 50 | 30 | 0 |

TABLE 3

| Carbon black number | number average particle size of Feret's diameter (nm) | Rate of primary particles in number (%) | number average particle size of Feret's diameter of primary particles (nm) |
|---|---|---|---|
| 1 | 42 | 65 | 25 |
| 2 | 40 | 72 | 25 |
| 3 | 39 | 89 | 25 |
| 4 | 28 | 98 | 25 |
| 5 | 48 | 53 | 28 |
| 6 | 47 | 87 | 28 |
| 7 | 41 | 89 | 28 |
| 8 | 29 | 97 | 28 |
| 9 | 36 | 77 | 28 |
| 10 | 32 | 87 | 28 |
| 11 | 33 | 83 | 28 |
| 12 | 80 | 35 | 25 |
| 13 | 180 | 7 | 25 |
| 14 | 210 | 0 | — |
| 15 | 210 | 1 | could not be measured |
| 16 | 210 | 0 | — |
| 17 | 320 | 15 | 25 |

The seamless belt-producing device described above was used for preparation of the intermediate transfer belt of Example 1. Polyphenylene sulfide (product name: E2180, manufactured by Toray Industries Inc.) was used as a resin material, and 30 parts by mass of carbon black #1 was added as a conductivity-enhancing agent and 2 parts by mass of calcium montanate as a lubricant with respect to 100 parts by mass of the resin material, to give a compound. The compound was supplied into the seamless belt-producing device 10 described above and extruded at a processing temperature of 290° C., which is 10° C. higher than the resin-material melting point (280° C.), into an endless belt having a film thickness of 500 μm, a peripheral length of 400 mm, and a surface resistance of $1\times10^7$ Ω/cm$^2$.

A fluoroplastic dispersion (containing 50 parts by mass of tetrafluoroethylene-hexafluoroethylene copolymer, trade name: Neoflon FFP, manufactured by Daikin Industries, Ltd) was spray-coated on the external peripheral surface of the endless belt, forming a dielectric layer (anti-toner-filming layer) having a thickness of 40 μm, to give an intermediate transfer belt.

Examples 2 to 12 and Comparative Examples 1 to 5

In Examples 2 to 12 and Comparative Examples 1 to 5, intermediate transfer belts were prepared in a similar manner to Example 1, except that the carbon black #1 used as a conductivity-enhancing agent in the intermediate transfer belt was replaced with carbon black #2 to #17. Carbon blacks #2 to #12 were used in Examples 2 to 12, and carbon blacks #13 to #16 were used in Comparative Examples 1 to 5.

(Evaluation)

Each of the development rollers obtained in Examples 1 to 15 and Comparative Examples 1 to 5 as described above was placed in Bizhub Pro C500 manufactured by Konica Minolta Business Technologies, Inc., and a solid image was printed on plain paper. The transmission light intensities at any 10 sites were determined by using a Sakura densitometer (manufactured by Konica Minolta Business Technologies, Inc.). The results are summarized in Table 4.

TABLE 4

| No. | Transmission Light Intensities | | |
|---|---|---|---|
| | Maximum | Minimum | Difference between Max. and Min. |
| Example1 | 1.83 | 1.78 | 0.05 |
| Example2 | 1.82 | 1.78 | 0.04 |
| Example3 | 1.82 | 1.79 | 0.03 |
| Example4 | 1.84 | 1.82 | 0.02 |
| Example5 | 1.80 | 1.74 | 0.06 |
| Example6 | 1.82 | 1.79 | 0.03 |
| Example7 | 1.83 | 1.80 | 0.03 |
| Example8 | 1.84 | 1.83 | 0.01 |
| Example9 | 1.81 | 1.77 | 0.04 |
| Example10 | 1.82 | 1.79 | 0.03 |
| Example11 | 1.81 | 1.79 | 0.02 |
| Example12 | 1.80 | 1.76 | 0.04 |
| Comparative Example1 | 1.81 | 1.69 | 0.12 |
| Comparative Example2 | 1.79 | 1.66 | 0.13 |
| Comparative Example3 | 1.77 | 1.60 | 0.17 |
| Comparative Example3 | 1.79 | 1.62 | 0.17 |
| Comparative Example4 | 1.79 | 1.67 | 0.12 |

Table 4 confirms that it is possible to reduce the lack in uniformity of density of a solid painted image and raise the image quality thereof when the image is formed by using an intermediate transfer belt obtained in Examples of the invention, compared to when an image is formed by using a development roller obtained in Comparative Examples.

Extrusion molding was used as an example of the method of producing the intermediate transfer belt in Examples and Comparative Examples, but the intermediate transfer belt according to the present invention is not limited to that prepared by the preparative method, and may also be prepared by the centrifugal casting method described in Japanese Unexamined Patent Publication No. 61-95361. When the centrifugal casting is used, conventional carbon blacks, which had a wider distribution of the secondary aggregate particle diameter, had a problems that it was not possible to obtain uniform conductivity because of uneven distribution of particle diameter in the thickness direction of the intermediate transfer belt, but it is possible to eliminate such a problems by using a carbon black having a number-average particle size of Feret's diameter of 5 to 300 nm and containing primary particles in an amount of 5% or more on a number basis, such as carbon black 1 to 12.

EXPLANATION OF NUMERALS

Figure 1:
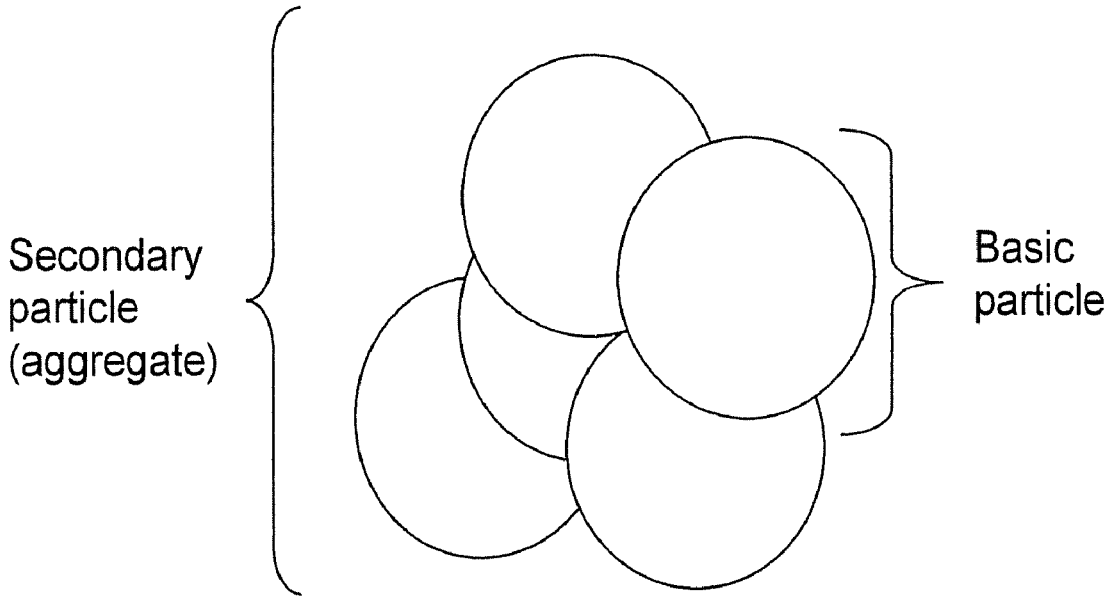
FIG. 1 is a view showing the relationship between secondary particle and basic particle.
Figure 2:
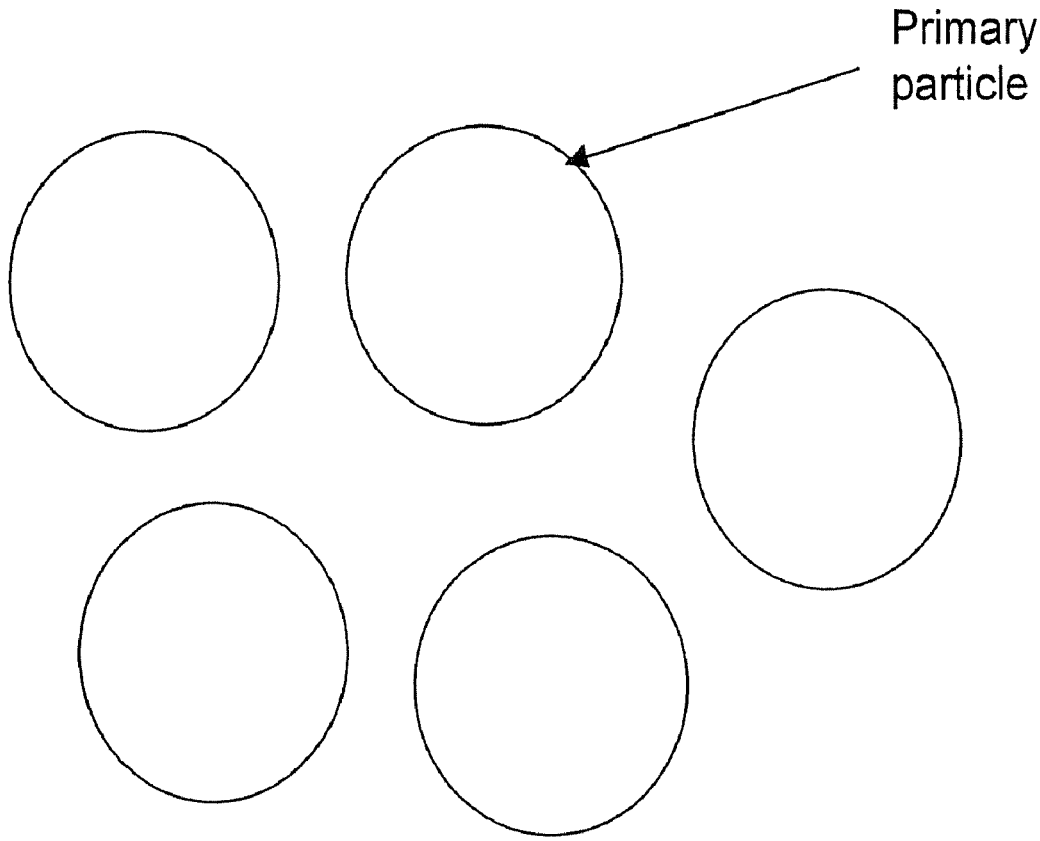
FIG. 2 is a view illustrating basic particles, which are separated from the secondary particle and exist stably.
Figure 3:
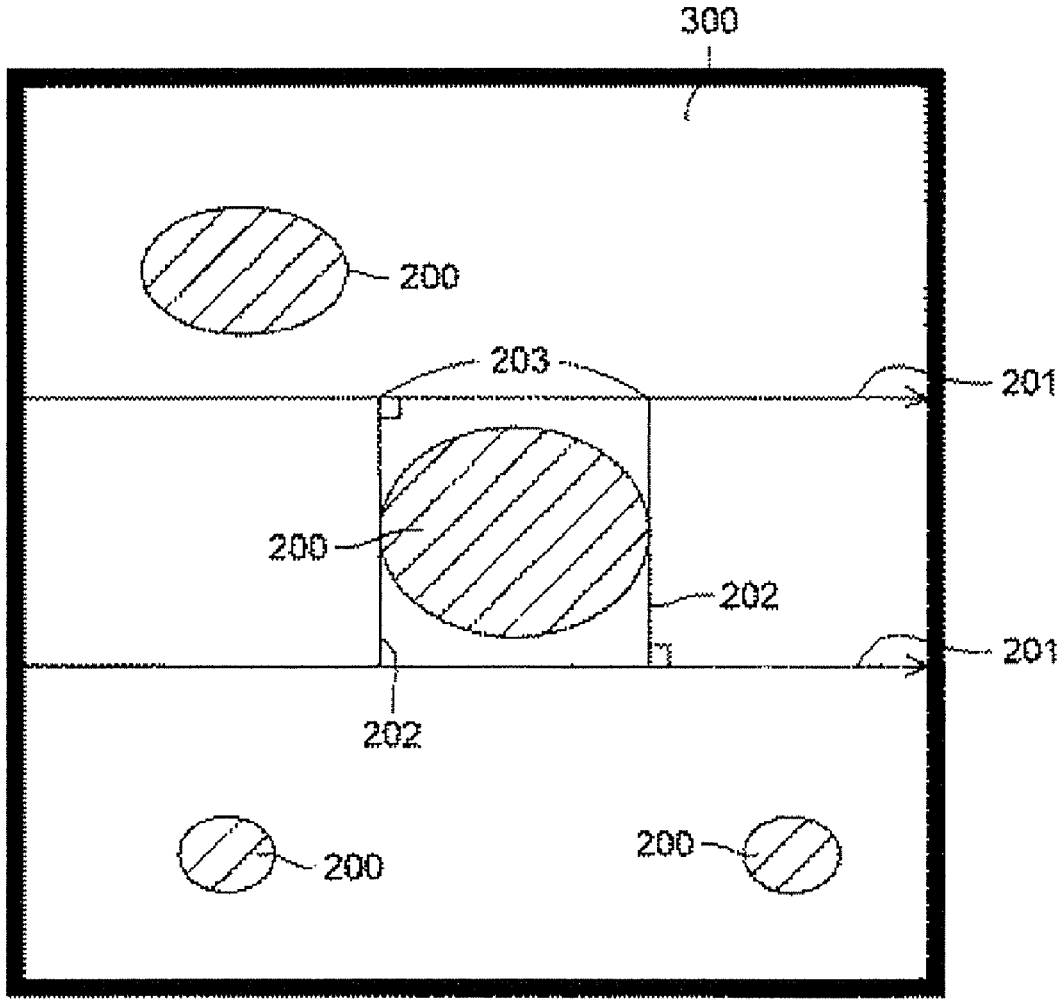
FIG. 3 is a view explaining Feret's diameter used in the invention.
Figure 4:
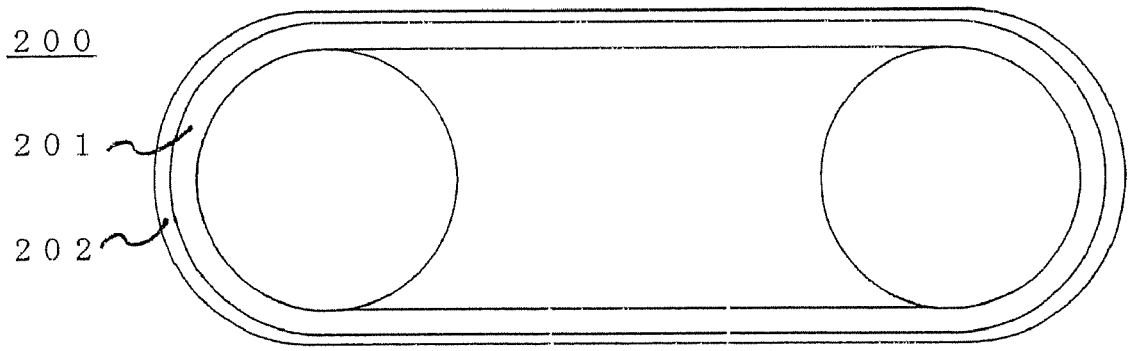
FIG. 4 is a view illustrating configuration of an intermediate transfer belt 200 in an embodiment of the present invention.
Figure 5:
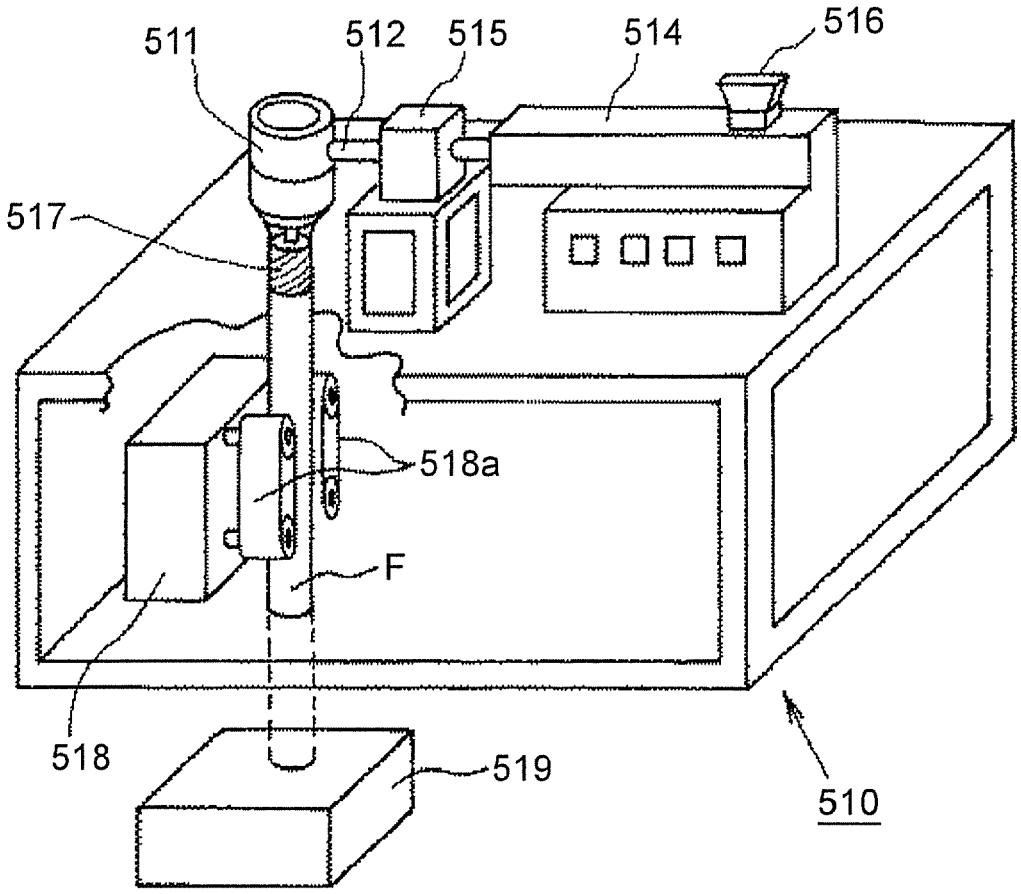
FIG. 5 is a perspective view illustrating configuration of a seamless belt-producing device 10 used in Examples and Comparative Examples of the present invention.
Figure 6:
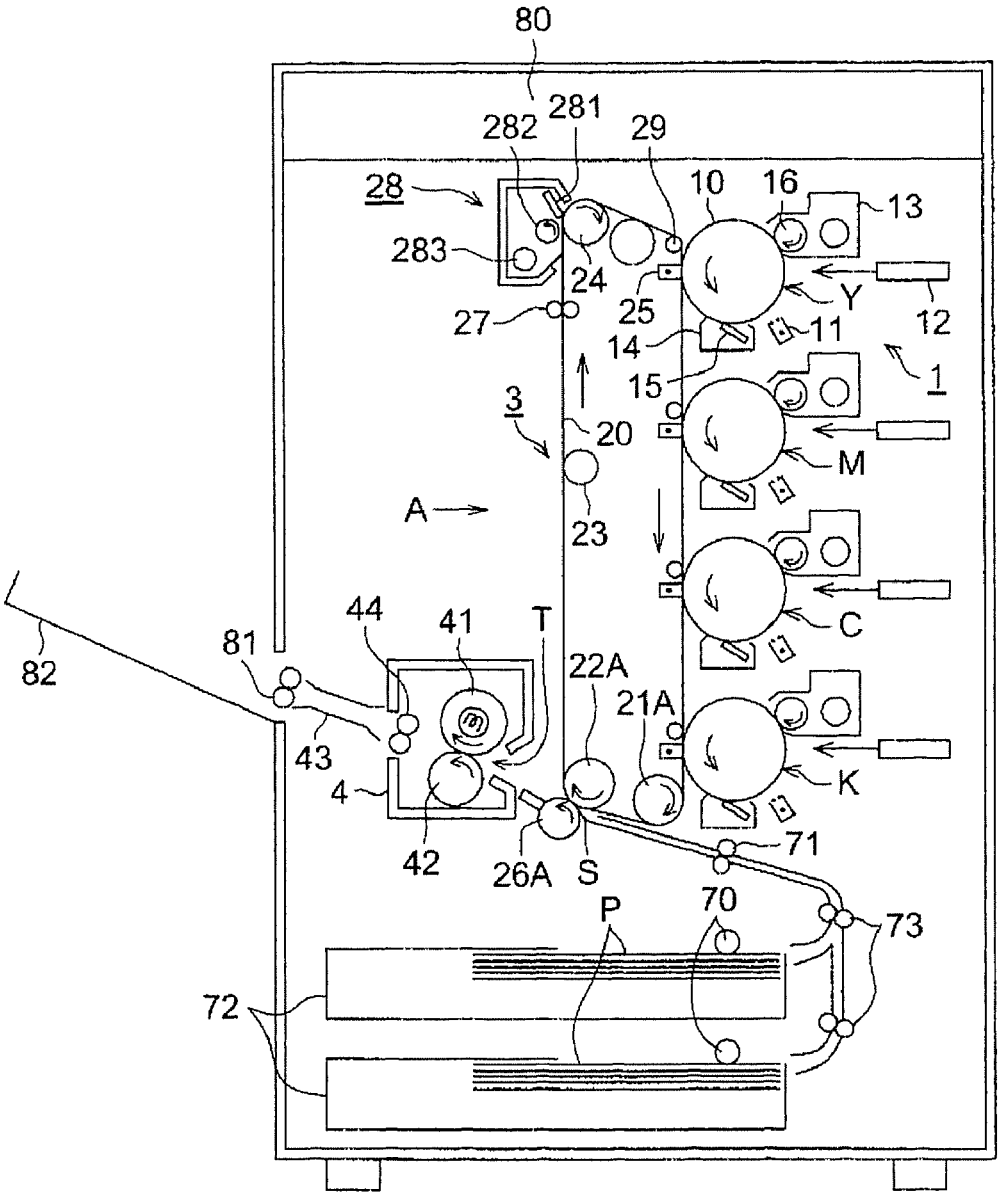
FIG. 6 is a sectional view illustrating configuration of a common electrophotographic image-forming apparatus employing an intermediate transfer belt.
Figure 7:
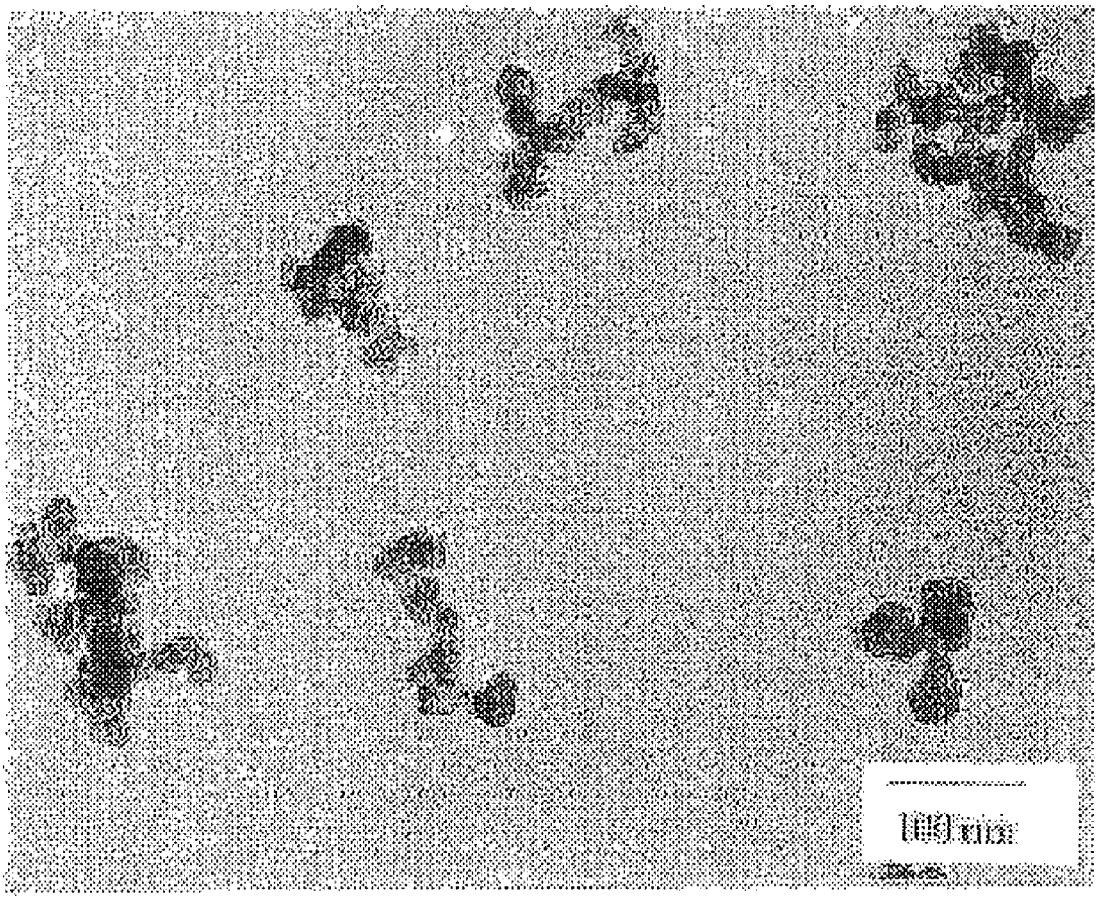
FIG. 7 is an explanatory drawing for aggregates (structures) of conventional carbon black.

200: Intermediate transfer belt
201: Base semiconductive film
202: Anti-toner-filming layer

The invention claimed is:

1. An intermediate transfer belt that is wound around at least a pair of supporting shafts, for receiving a toner image transferred from a photosensitive member, comprising at least one resin layer, the resin layer comprising a carbon black dispersed in a base resin material, the carbon black having a number-average particle size of Feret's diameter of 5 to 300 nm and containing primary particles in an amount of 5% or more on a number basis, wherein the carbon black is surface-treated with an organic compound.

2. The intermediate transfer belt according to claim 1, wherein the resin layer has multiple resin layers and the carbon black is dispersed in at least one resin layer among the multiple resin layers.

3. The intermediate transfer belt according to claim 2, wherein the multiple resin layers include a base layer and a surface layer formed on the base layer.

4. The intermediate transfer belt according to claim 3, wherein the carbon black is dispersed in the base layer.

5. The intermediate transfer belt according to claim 3, wherein the carbon black is dispersed in the surface layer.

6. The intermediate transfer belt according to claim 1, wherein the organic compound includes at least one phenol compound and/or one amine compound.

* * * * *